United States Patent [19]

Gremillet

[11] 4,010,837

[45] Mar. 8, 1977

[54] SYLLABIC KEYBOARD CONTROLLED DEVICES

[76] Inventor: Jean Gremillet, 64 Avenue Felix Faure, Paris 15°, France

[22] Filed: Aug. 30, 1974

[21] Appl. No.: 502,184

Related U.S. Application Data

[62] Division of Ser. No. 259,051, June 2, 1972, abandoned.

[30] Foreign Application Priority Data

June 21, 1971 France ..... 71.22450

[52] U.S. Cl. ..... 197/7; 197/20; 197/100

[51] Int. Cl.² ..... B41J 3/26; B41J 3/51

[58] Field of Search ..... 197/7, 19, 20, 82, 98, 197/100, 99, 11

[56] References Cited

UNITED STATES PATENTS

| | | | |
|---|---|---|---|
| 2,770,304 | 11/1956 | Tholstrup | 197/7 X |
| 3,073,427 | 1/1963 | Gremillet | 197/7 |
| 3,428,747 | 2/1969 | Alferieff | 197/19 X |
| 3,604,548 | 9/1971 | Ritzerfeld | 197/20 |
| 3,643,773 | 2/1972 | Holmes | 197/19 X |
| 3,730,323 | 5/1973 | Watanabe | 197/82 |
| 3,768,623 | 8/1973 | Asahi et al. | 197/19 |

*Primary Examiner*—Edgar S. Burr
*Assistant Examiner*—Paul T. Sewell
*Attorney, Agent, or Firm*—Robert E. Burns; Emmanuel J. Lobato; Bruce L. Adams

[57] ABSTRACT

A syllabic keyboard controlled device in which a syllabic keyboard controls a non syllabic printer by means of a storage unit (memory unit). The storage unit comprises a main memory to which the syllabic keyboard transmits through coding matrices pulses which correspond to the characters assigned to the simultaneously depressed keys. The storage unit includes a device for reading in the main memory each code corresponding to a character, to a space, or to a subsidiary operation, and includes moreover a decoding matrix at the output of which is connected : either a non syllabic printer, or a system to produce a permanent or semi-permanent record which may control posteriorily a non syllabic printing mechanism, for example that of a typewriter, that of a Linotype (trade-mark), or a device for photocomposition or for photoprinting.

17 Claims, 27 Drawing Figures

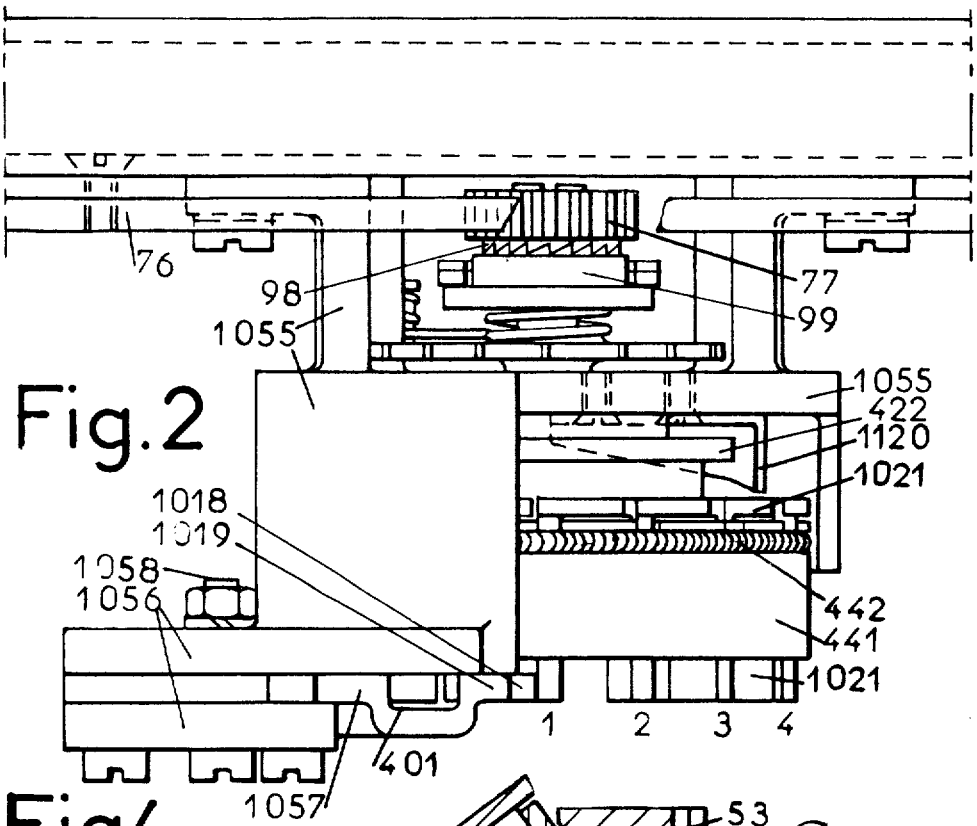
Fig. 2
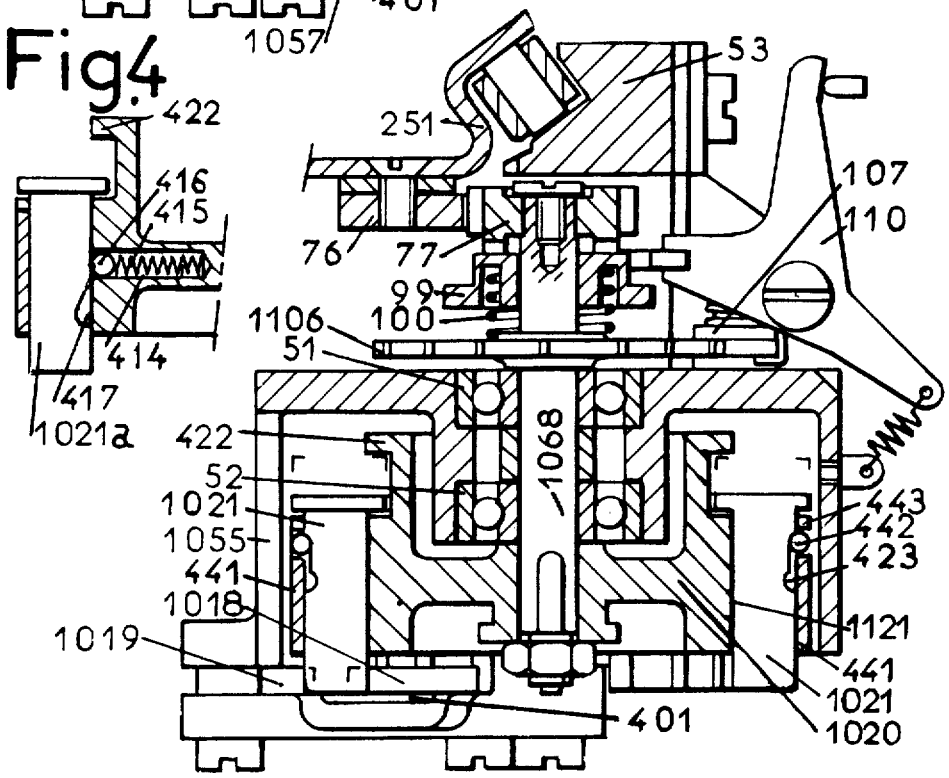
Fig. 4
Fig. 3

Part a

Part b

Part c

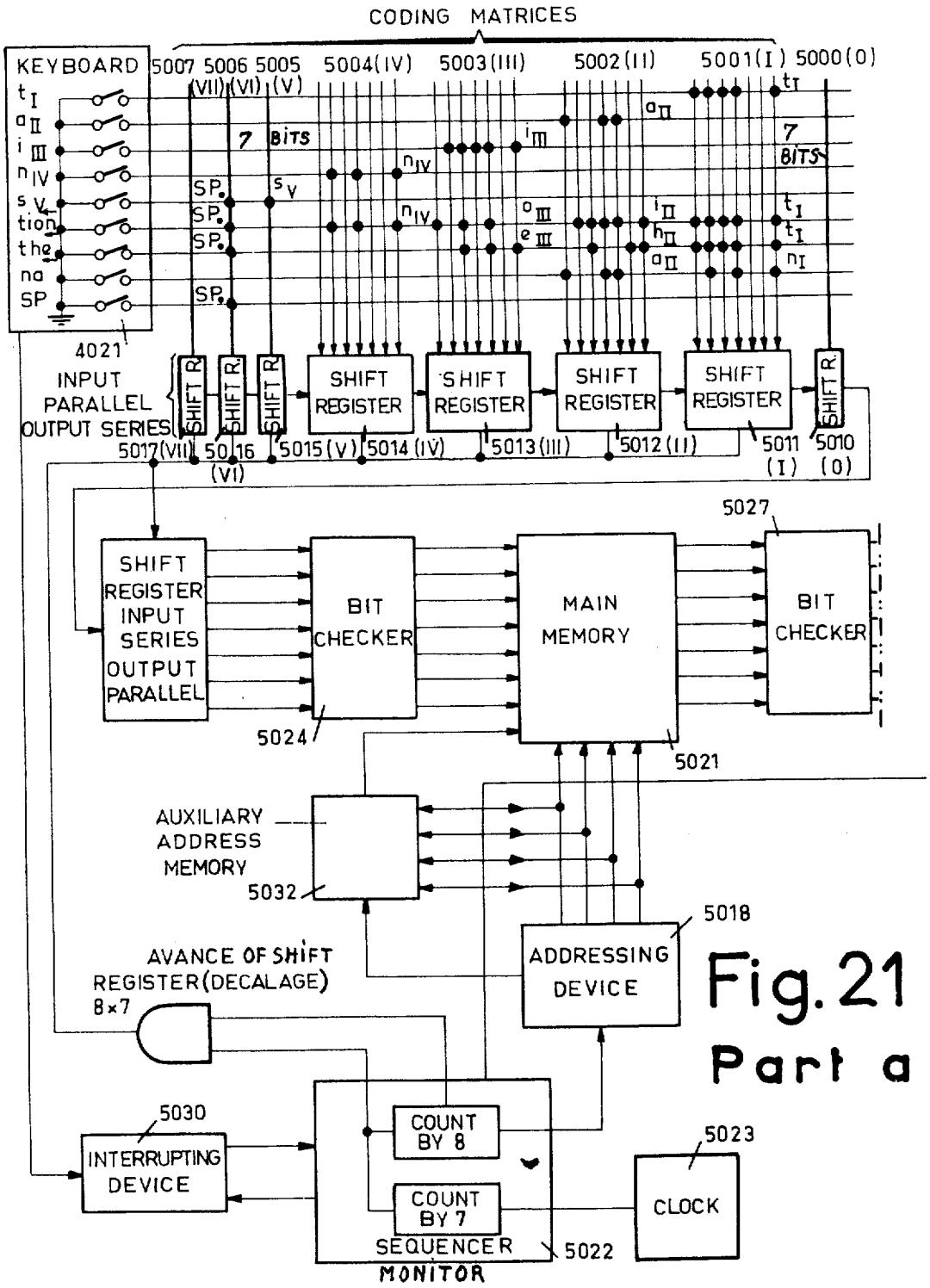
Fig. 21 Part a

Part b

SYLLABIC KEYBOARD CONTROLLED DEVICES

CROSS-REFERENCES TO RELATED APPLICATIONS

This application is a division of Ser. No. 259,051, filed June 2, 1972, now abandoned, and refiled as continuation Ser. No. 502,188, now U.S. Pat. No. 3.944,042. Other continuing applications of Ser. No. 259,051 are Ser. No. 502,190, now U.S. Pat. No. 3,944,043 and Ser. No. 502,192.

BACKGROUND OF THE INVENTION.

1. Field of the Invention

Control, by a syllabic keyboard, of non syllabic printers or of machines for composition, for example Linotype (trade-mark), and photo-composers, utilized in the Graphic Arts. The invention may be utilized in accounting groupings and as peripheric elements of a computer.

2. Description of the Prior Art

Typewriters for the simultaneous printing of several characters borne by different type bars, several of them being set in motion by striking a single key that provides spaces at the same time, have already been put forward by the U.S. Pat. No. 3,073,427 to Gremillet.

Moreover, there are already electric machines in which the printing, as well as certain subsidiary functions, are obtained by the engagement of the control parts on a motor-driven cylinder, but these machines allow the typist to type only one character at a time, and that without spacing.

There are also machines automatically operated by a storage and machines that are connected together at a distance, each being both transmitter and receiver, but all these machines allow the typist to type on the keyboard one character only at a time and that without spacing.

In the Prior Art there is no device or combination of devices in which a syllabic keyboard controls non syllabic printers or non syllabic storage devices.

Summary of the Invention

The object of the invention is to allow a typist to type on a syllabic keyboard to control, either immediately, or later, non syllabic printers or a non syllabic device for permanent or semi-permanent storage; the control of the printers or of the storage device being effected by the keyboard through a storage unit.

The Invention relates to a Keyboard-controlled device including a syllabic keyboard certain keys of which can be simultaneously depressed and certain keys of which each simultaneously control several characters corresponding to different printing points, the keys operating electric switches.

The device includes also a storage unit comprising coding matrices and a main memory. The keyboard transmits to the main memory pulses corresponding to the simultaneously depressed keys, through the coding matrices.

The storage unit comprises moreover a system to read successively in the main memory the code corresponding to each character, to the space, or to a subsidiary operation. The storage unit comprises also a decoding matrix.

At the output of the decoding matrix may be connected a non syllabic printer and/or a system to produce a permanent or semi-permanent record. The reader controls the printer and/or the recording system through the decoding matrix.

The permanent or semi-permanent record may control posteriorily either a non syllabic printer, or a device for photo-composition or for photo-printing, or a computer, for example.

The storage unit may comprise provisional memories for storage of the elements transmitted by the keyboard. They receive simultaneously all the codes corresponding to the simultaneously depressed keys and send them successively to the main memory.

The main memory may comprise as storage medium : punched or magnetic tapes or cards, or electronic means, for example.

When the storage medium is a tape, the advancing of this tape by differentiated jumps may be controlled by a cogged wheel with mobile cogs.

BRIEF DESCRIPTION OF DRAWINGS

FIG. 2: Wheel with mobile cogs parallel to the axis of rotation, the anchor, and their supports. Front view, enlarged.

FIG. 3: Wheel with mobile cogs parallel to the axis of rotation, the anchor, and their supports. Section through the axis of rotation, seen from the right side.

FIG. 4: Positioning of each cog by a spring and a ball. Partial section of the wheel. Enlarged view.

DESCRIPTION

General considerations

Figure 1:
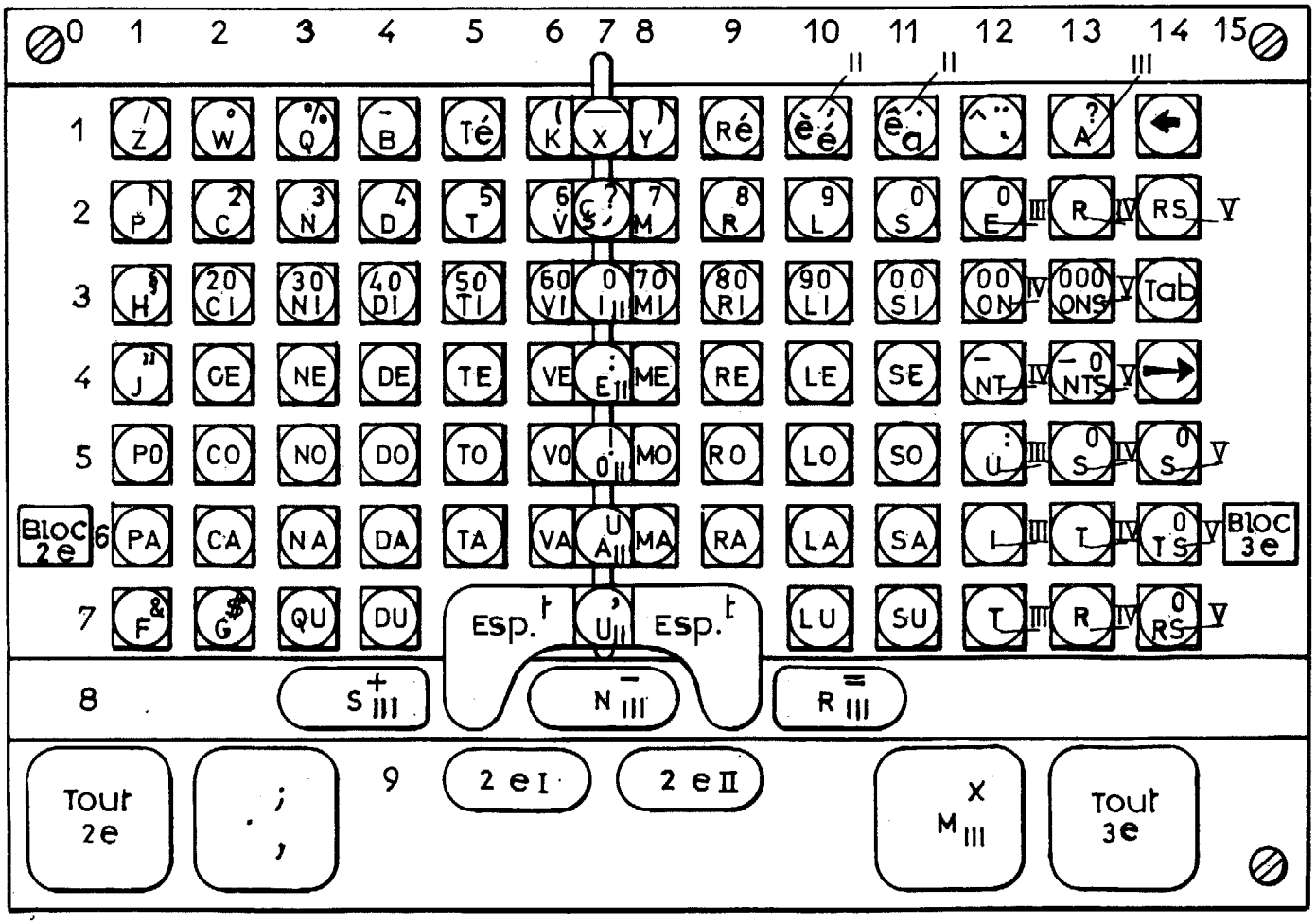
FIG. 1: Keyboard of the type proposed by U.S. Pat. No. 3,073,427. Layout for the French language. Top view.

FIG. 1 is an example of a syllabic keyboard proposed by U.S. Pat. No. 3,073,427 to Gremillet. Keyboards of that type are entirely described in this patent. Its layout corresponds specially to the French language. It may be utilised with the form of an electric switch keyboard.

Figure 7:
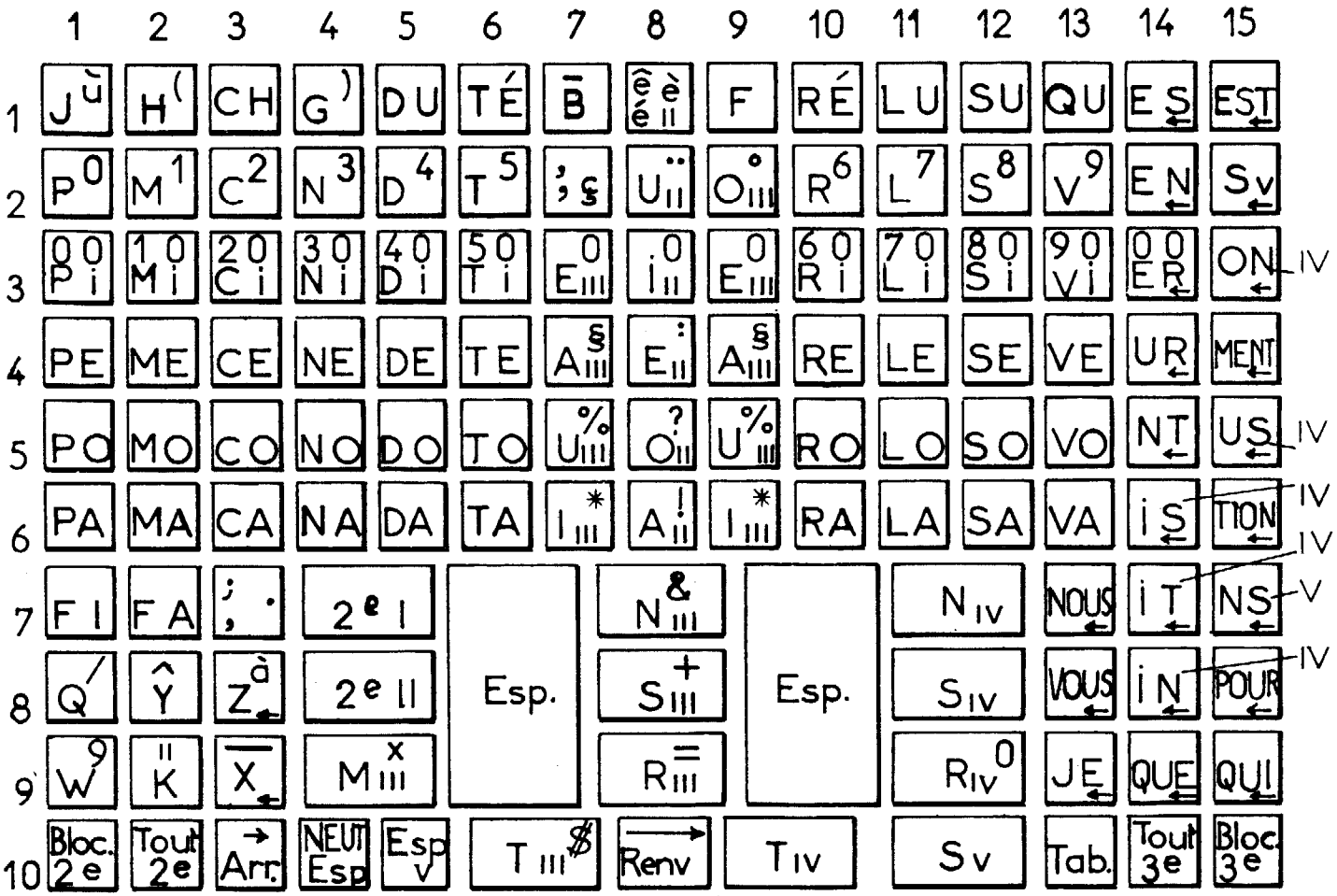
FIG. 7: Switchboard. Example of a layout for the French language.
Figure 8:
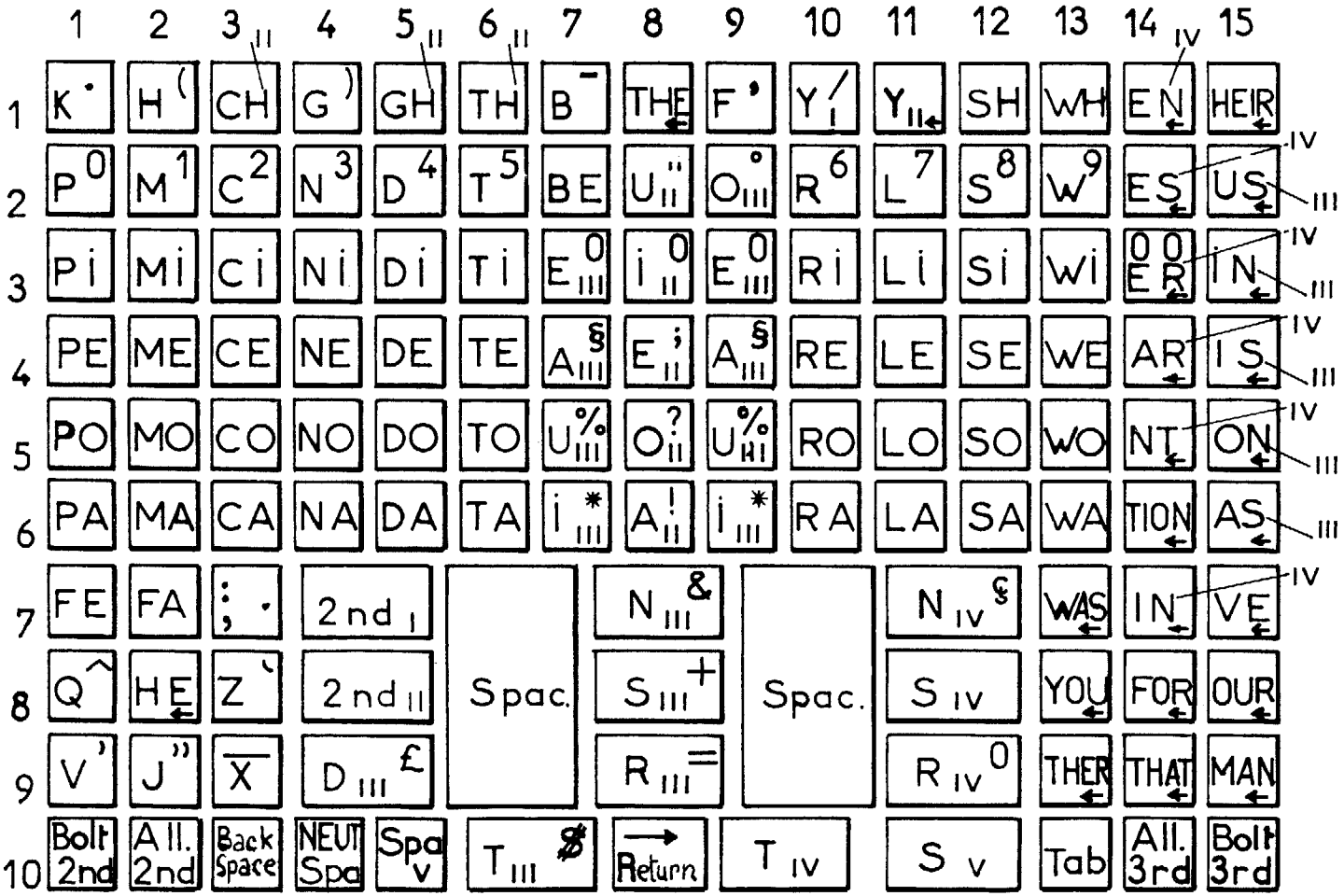
FIG. 8: Switchboard. Example of a layout for the English language.
Figure 9:
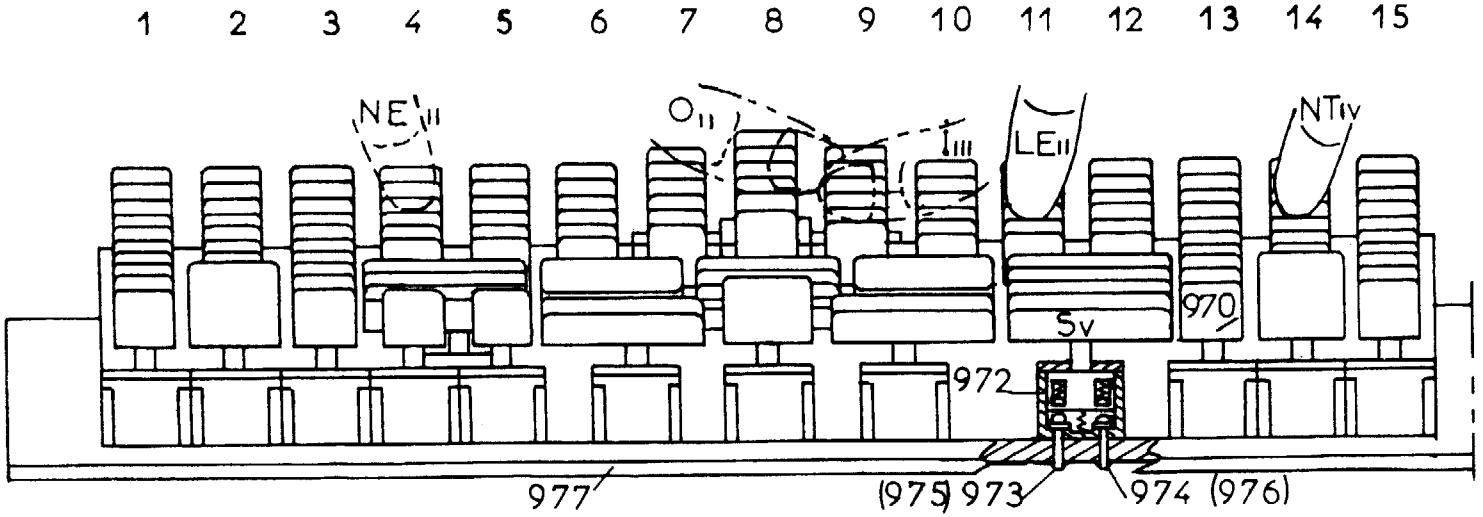
FIG. 9: Switchboard. Front view, showing the differences of level of the keys and the position of the fingers on certain keys.

FIG. 8 shows a type of keyboard the layout of which is for the English language. This keyboard includes, among other features, keys for large combinations ("that," "heir," "tion," . . . ) that enable, at the depression of a single key, the printing of up to four characters at a time, and the simultaneous production of the space that has to follow them. On the other hand, numerous keys corresponding to Groups III and IV ($^{E}$III,-$^{N}$III,$^{T}$IV) are situated at the centre of the keyboard to facilitate the fingering. The switch keyboards shown in FIGS. 7, 8, 16 and 20 are entirely described in the copending application Ser. No. 502,188.

Figure 14:
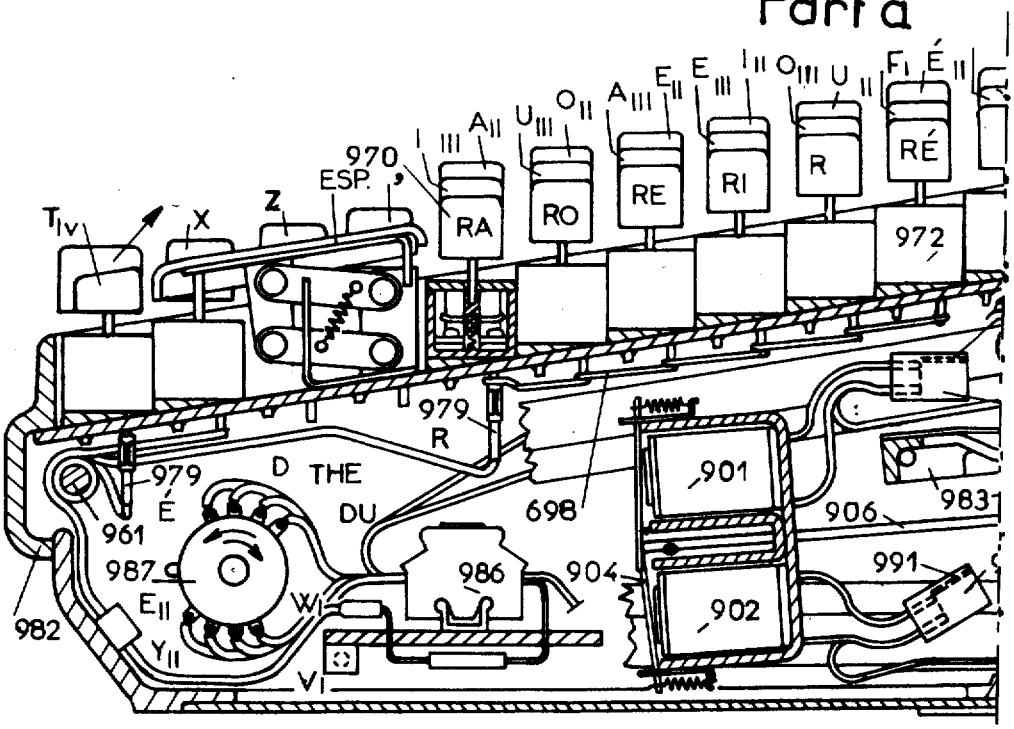
FIG. 14: Comprising parts designated **14*a*–14*c***. The whole machine in the variant comprising a keyboard made up of switches that actuate the engagements on the driving cylinder and the escapement mechanism by electromagnetic means. Longitudinal section seen from the right.
Figure 14:
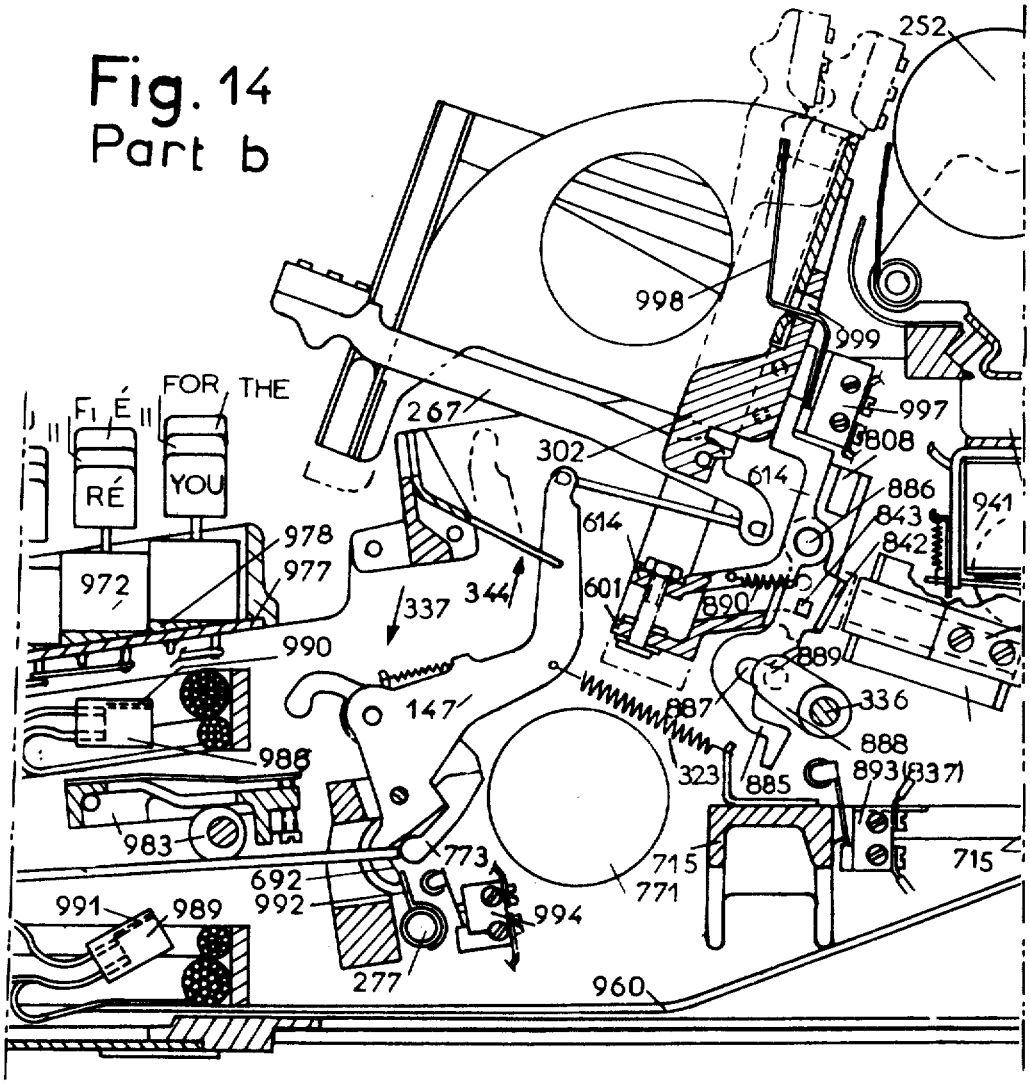
Figure 14:
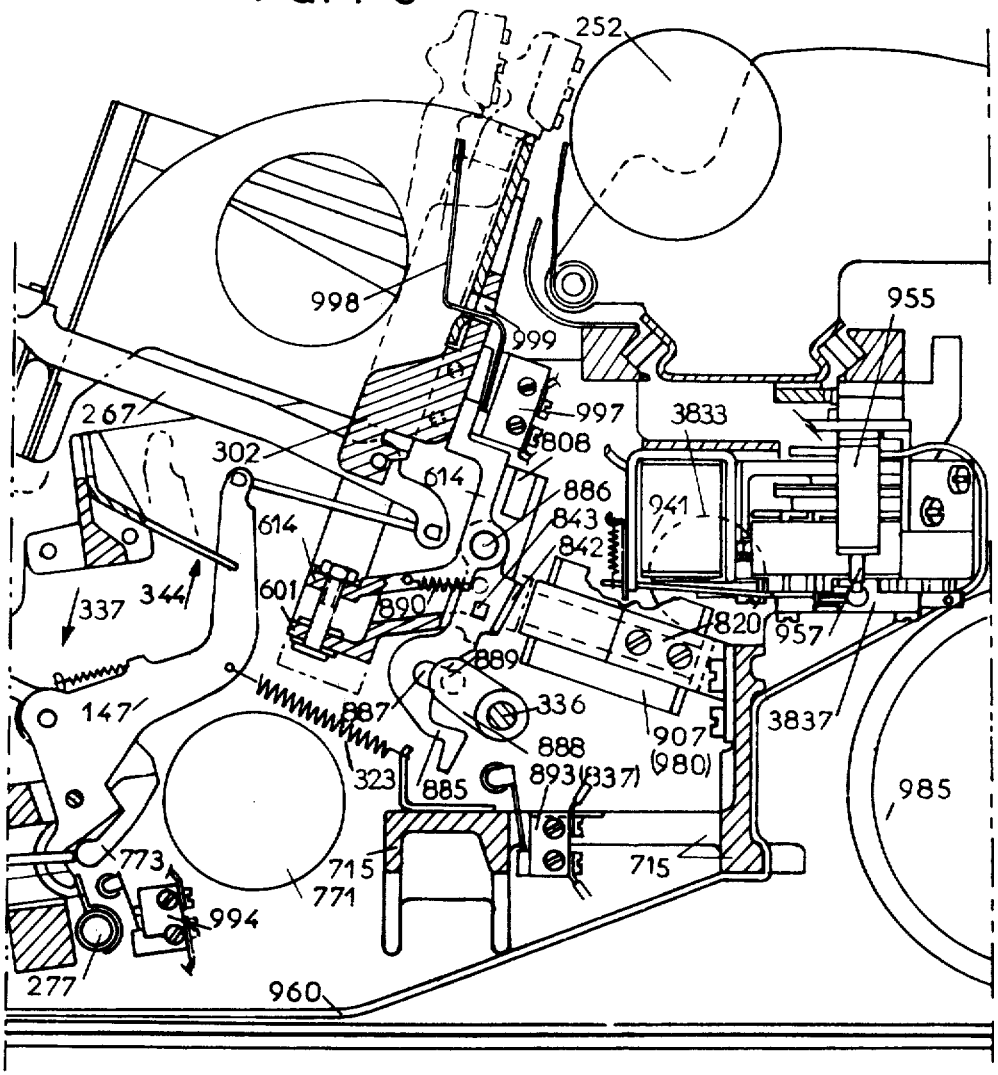
Figure 16:
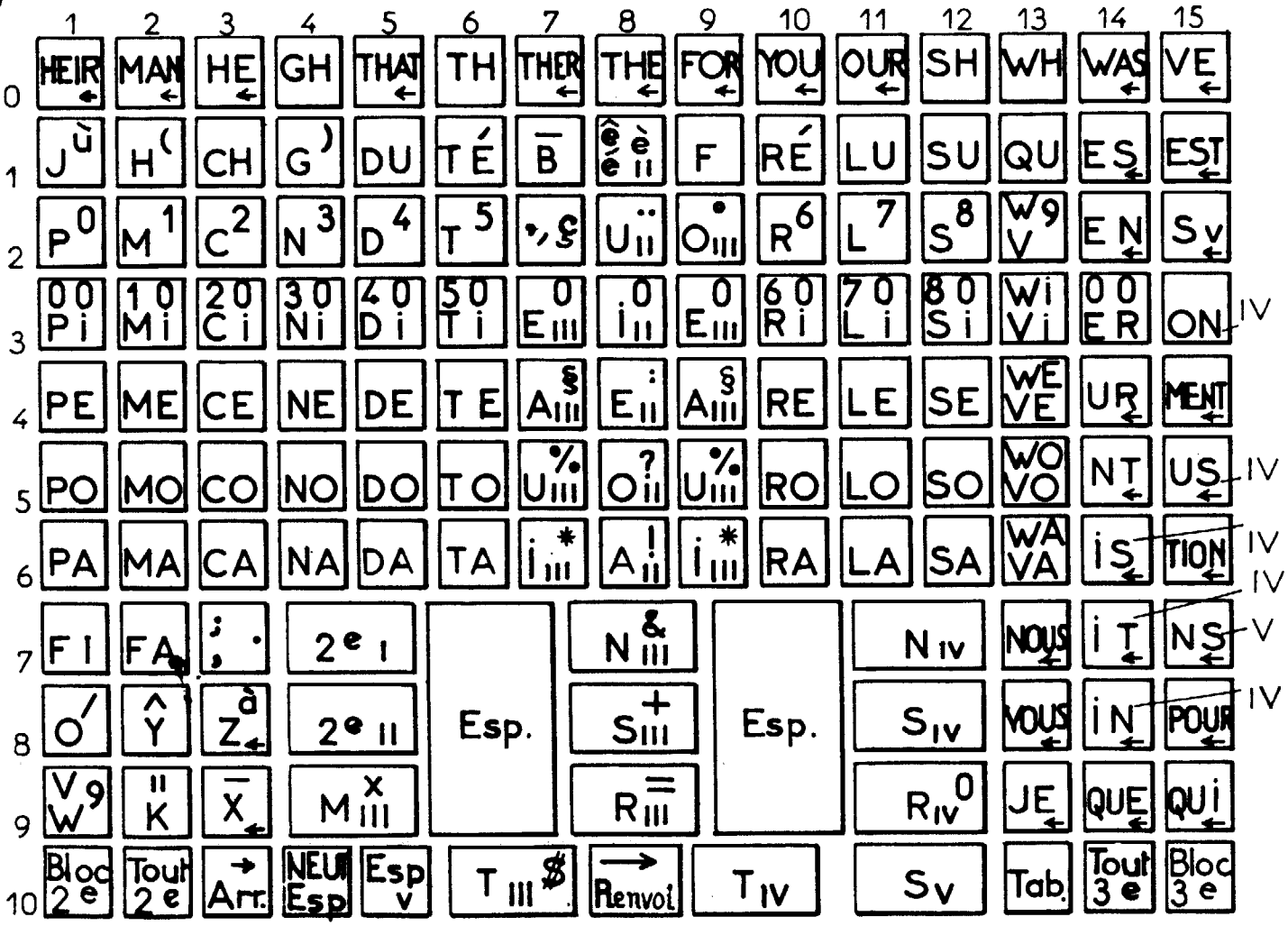
FIG. 16: Bilingual keyboard including a row of supplementary keys and certain keys whose attribution may be modified by a commutator.

Various combinations of the keyboard or of the complete machine, as described, with other components The machine shown in FIG. 14, whatever the syllabic keyboard which is used from amongst those described, can easily be connected up in such a way that the keyboard controls other similar machines or different syllabic printing mechanisms at the same time, or so that its printing mechanism be controlled by the keyboard of another machine having an identical syllabic keyboard, or by a storage unit.

It syllabic can also be connected in such a way that its keyboard controls a memorising device at the same time, for example, a recording device in a magnetic storage unit, or card punchers or tape punchers, the storage medium controling a printing mechanism later. This latter can be either the printing mechanism of the machine itself or another one.

For these last uses, a complete machine, such as the one shown in FIG. 14, can be used, or only the keyboard with the electrical circuits which it uses, without using the printing mechanism.

The syllabic keyboard can even control a printing mechanism which is alphabetic (non syllabic), through a buffer storage unit.

In reality, there is always a printing mechanism but this in certain cases, is at a distance and the printing is sometimes deferred, thanks to a memory unit.

Considering the assembly of the forseen combinations, of either the entire machine shown FIG. 14 or one of its sub-assemblies, with one or several other mechanisms or devices, or with another machine, two classes can be distinguished:

1st class — The described syllabic machine or one of its sub-assemblies, controls, optionally or permanently, a printing machenism which is at a distance and this, either directly or through a storage unit. In this case the machine is called a "transmitter."

2nd class — The printing mechanism of the machine, which is syllabic, is controlled by a device which is at a distance, directly, or through the intermediary of a storage unit. In this case the machine is called a "receiver."

In the case where the machine (FIG. 14) is a transmitter, an additional circuit is established at each exit from the bar 986, connected at the other end, either to the circuit corresponding to the exterior printing mechanism which the machine is to control directly or to the suitable elements in the storage unit which is to be inserted eventually. Where the machine is a receiver, the additional circuits, from the mechanism at a distance which controls the machine directly, or from the storage unit which controls it after the striking, are connected at each entry of the bar 986; through these circuits, the pulses, depending on the circuit, pass to control a character, a space, or a subsidiary operation. Several of these pulses are however simultaneous, as if they came directly from the keyboard of the machine.

If a buffer storage is used, the recording device, the memory medium and the device which controls the displacement of the latter, as well as the reader are each, according to the case, included in the machine or next to it, or at a distance.

The syllabic keyboard can be used in an assembly which does not include any printing mechanism situated near it, but only a storage unit.

In this case in FIG. 14, only the keyboard and the circuits which it controls up to and including the bar 986, are retained.

When using a memory medium made up of a magnetic or punched tape and if the printing mechanism which the memory is to control later is syllabic, recordings which are simultaneous but in which each group of bits corresponds to a character or to a space, according to a code, can be used.

In this case, to record a syllable or part of a syllable in the memory, the different groups of bits corresponding to different characters and to the possible space which corresponds to the key or keys which are depressed simultaneously, are recorded simultaneously. If a general code which is habitually used to control an alphabetic (non syllabic) printing mechanism, is employed, each of the elements coded is recorded in a different transversal line in the memory, that is, in a line perpendicular to the direction of recording and of reading in the memory.

These different code elements which correspond each to a character, to a spacing, or to a subsidiary operation respectively can thus be recorded simultaneously by an assembly of devices (punchers or magnetic recording head) which cover several of these transversal lines on the memory medium (such as, for example, punched or magnetic tapes or cards).

The advance of the tape (punched or magnetic) is controlled by a device (FIG. 19 and scheme 18) which makes a jumpwise advance in a jump after each assembly of simultaneous recordings, the successive jumps being of different lengths, proportional to the number of character codes simultaneously recorded and possibly increased by one line for a spacing code. This device will be described later.

Alternatively the recordings may be realised simultaneously in a primary memory made up, for example, of shift registers. This primary memory then transmits, successively, each of the code elements, each one corresponding to a character or to a space or to a subsidiary function to a second memory which is the main memory and can be for example: a punched or magnetic card or tape or a magnetic disc. This solution enables the use, for recording in the main memory, of standard devices used normally when the printing is alphabetic (non syllabic) that is, character by character, the space being controlled alone.

If the printing mechanisms to be controlled later by this second memory is itself syllabic, in order to control the printing afterwards, use is made of a reader and of a decoder, which are made up in such a way as to effect simultaneous reading of the different lines of the main memory in which the recording has been effected for the same group of simultaneous depressed keys.

A jump advance is controlled by a signal which has been automatically recorded during the recording of the group of elements in the main memory. Those jumps may also be controlled by the wheel with moveable cogs which will be described. This solution enables the same recordings to control either a syllabic printing mechanism or an alphabetic (non syllabic) printing mechanism, ulteriorly.

In order to avoid jumps of different lengths, recording without a code and reading without decoding may be used. In this case the use of a buffer storage device, the mechanism which alters the lengths of the jumps and the use of a decoder are avoided.

The memory medium, in this case, must be wide enough to include as many tracks as there are character supports (such as type bars) and subsidiary controls. In this case, for example, approximately 46 tracks are required for the characters, plus the tracks for the controlling of subsidiary operations, so a total of 50 tracks to control a syllabic printing mechanism similar to the one shown in FIG. 14 with a keyboard similar to the one shown in FIG. 8.

Such a recording without a code can be used in the case where the printing mechanism which the storage is to control is alphabetic (non syllabic) but also when this mechanism is syllabic. When it is syllabic, a special code which enables the expressing of all the combinations of characters, with or without spacing, which can be struck in one operation on the syllabic keyboard shown in FIG. 7 or 8 or on a similar keyboard, and of all the subsidiary operations, can be adopted. To obtain this, the device must be able to record simultaneously 15 marks (holes or magnetic recordings) in the memory medium.

This reduces the tape width to one permitting 15 or 16 tracks or channels.

Another solution, which also enables the avoiding of jumps of differentiated lengths, consists of realising each of the groups of recording simultaneously on two successive lines of the tape. The width of the tape only requires the use of 8 tracks. The jumps are uniformly of two lines, thus enabling the use of a simple device, similar to those normally used when the advance is uniformly of only one line, to control the jumps. But, in this case, the reader must be made up in such a way as to enable its reading elements to cover and to read two lines at a time.

The successive recordings of elements are controlled directly by the striking, without the interposing of a buffer storage.

In the cases where the keyboard is syllabic but where the printing mechanism is alphabetic (non syllabic), one benefits, for the typing of a text and for its recording in the storage device from the full increase in speed which the syllabic typing on the described keyboard gives, in comparison with the typing on the alphabetic (non syllabic) keyboard.

At the moment when the storage device controls the non syllabic printing device, one can obtain this printing at the maximum speed at which the considered printing device can function.

In the case where the printing mechanism which the storage device will control afterwards is itself syllabic, one benefits, for this printing, from the increase in speed resulting from the syllabic printing, in relation to non syllabic printing.

Thus, for example, if the printing mechanism includes type bars, the syllabic printing enables a speed more than double that of a non-syllabic device with type bars.

List of foreseen combinations

A definition has just been given of the outlines of various means, each one of which enables the realization of several combinations between a syllabic keyboard and a printing mechanism, which is either syllabic or alphabetic (non-syllabic).

For a given combination, one considers not only the components united one next to the other in a given machine but also the elements at a distance one from the other and which function as a unit, either at the same time or at different times, one then controlling the others by means of a storage unit.

For example, if one keyboard controls the recording in the storage, the latter controlling a printing mechanism afterwards, the keyboard, the storage unit and the printing mechanism are all part of the same combination.

A list of such combinations with a brief description of each follows.

Each definition is preceded by a symbol made up of capital letters for the substantives and small letters for the adjectives as well as for the form of storage medium.

in these symbols:

| | | |
|---|---|---|
| C = Keyboard | b = band or tape | s = syllabic |
| I = Printing mechanism | c = card | a = alphabetic (non-syllabic) |
| M = Memory | d = disc | |
| | e = electronic | m = magnetic |
| | n = numerous | p = punched |

The list which follows is not limitative.

Cs Is — Syllabic keyboard controlling a syllabic printing mechanism.

This, for example, is the combination shown in FIG. 14. The keyboard (FIGS. 7, 8, 16, 20, 9, 13) controls the printing mechanism through mechanical, electrical or electronic connections. The printing is immediate.

This combination is described in the copending applications Ser. Nos. 502,188, 502,190, and 502,192. For the following other combinations, the combined devices are connected to the connecting bar 946 (FIG. 1 as it will be explained later.

Cs n Is — Same combination as Cs Is but the keyboard controls, at the same time and in addition, one or more other syllabic printing mechanisms situated outside the machine, which are connected to the connecting bar 946 (FIG. 14). These mechanisms can be identical to the one forming part of the machine, or they can be similar or different.

Cs Is M — Same combinations as Cs Is but the keyboard also controls in parallel, a storage unit. This unit can be a part of the same machine or situated at a distance and linked to the circuits through which the keyboard transmits pulses, for example to the connecting bar 946 (FIG. 14). It is intended to control printing by one or more printing mechanisms afterwards.

Cs Is Mp — Same combination as Cs Is M but the recordings in the storage unit are constituted by punching.

Cs Is Mm — Same combination as Cs Is M but the storage unit is magnetic.

Cs Is Mdm — Same combination as Cs Is Mm but in the storage unit the storage medium is constituted by magnetic discs. This form is particularly interesting for the recording of standard paragraphs of letters or of information which must be founded again rapidly.

Cs M — Combination of a syllabic keyboard with a storage unit; the memory serving to control a printing mechanism afterwards. This combination is the same as Cs Is M with the difference that the machine has no printing mechanism incorporated in the same assembly.

Cs M Ia — Combination of a syllabic keyboard with an alphabetic non-syllabic, printing mechanism by the through an intermediate buffer storage unit.

The buffer storage unit receives the pulses corresponding to the characters incorporated in the groups of characters, with or without spacing, and at the typing cadence of the syllabic typing. A reader, of well-known type, reads in the buffer storage and controls the printing in alphabetic print, that is, letter by letter, the spaces being separated, but at the maximal cadence at which the non-syllabic printing mechanism can function.

In this form of embodiment, the printing mechanism can be of any type. For example, the type support can be made up of type bars, of a cylinder or of a sphere. The buffer storage unit being made up of elements already well-known in themselves, it is not necessary to describe them in detail here. The same goes for the printing mechanism. What is characteristic is the combination of the described syllabic keyboard with a storage unit which receives the syllabic code elements and with a reading and printing mechanism which is not syllabic.

The nature of the various buffer storage units which can be used is described later.

Cs Mbp Ia — Same combination as Cs M Ia but the buffer storage medium is made up of a punched tape. The punched tape can be recovered and stored to control the same printing mechanism or other printing mechanisms, of which the structure may be different, alterwards.

Cs Mm Ia — This is the combination Cs M Ia, when the buffer storage unit is magnetic. An additional advantage is the fact that the same storage medium can be used several times.

Figure 18:
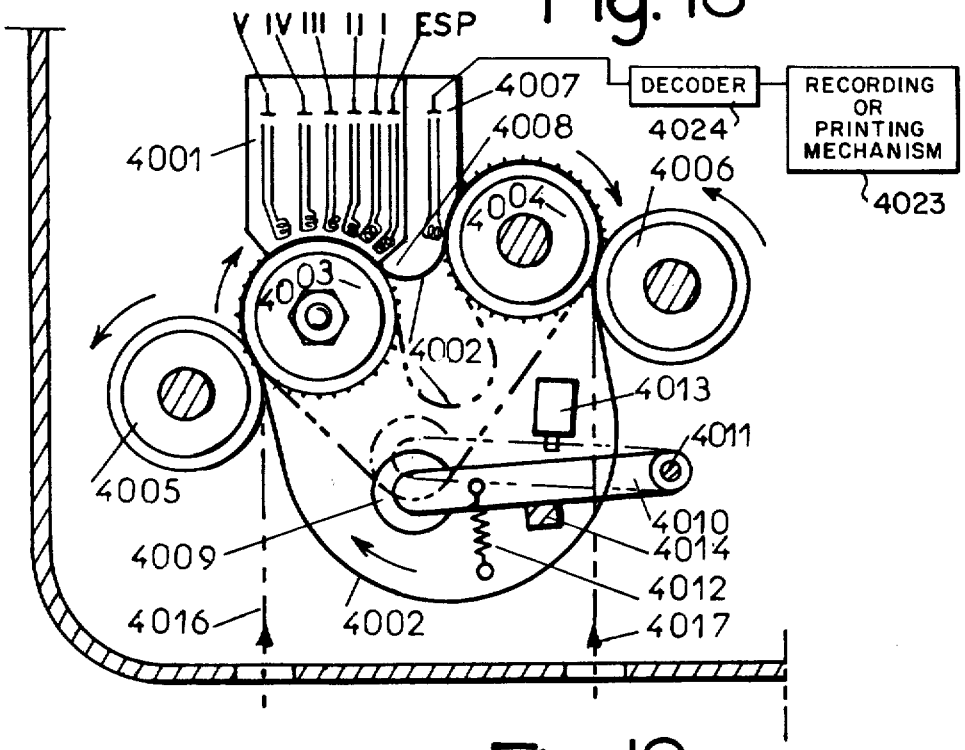
FIG. 18: Scheme of the buffer storage unit in the machine shown in FIG. 17, when the main memory comprises a magnetic tape as memory medium. Section, seen from the left.

Cs Mbm Ia — Same combination as Cs Mm Ia but with the precision that the storage medium is made up of a magnetic tape. An example of this embodiment is described elsewhere. Its storage unit is illustrated in FIG. 18. The same device enables the use of a continuous tape, or a looped endless tape.

Cs M Ia M — Same combination as Cs M Ia but, in addition to the buffer storage unit, the mechanism is fitted with another storage device the memory medium of which is continuous and which will serve to re-operate the same printing mechanism or another similar or different mechanism afterwards.

Cs Mm Ia Mp — Same combination as Cs M Ia M but in which the first buffer storage medium is magnetic and where a second storage unit comprises a perforated memory medium.

Cs Mm Ia Mbp — Same combinations as Cs Mm Ia Mp but with the precision that the second storage unit comprises a punched tape. In this case, the device which ensures the advance of the tape can be identical or similar to the one which is usually used with a normal electric typewriter, connected to a recording device which comprises a punched memory medium. It is the pulses transmitted by the buffer storage unit which controls in parallel the non syllabic printing mechanism and the recording by punching. The punched storage medium enables the future controlling of the same printing mechanism or another one, at a distance.

Cs Me Ia — Same combination as Cs M Ia but in the case where the buffer storage unit comprises an electronic device. A form of this embodiment using such a device will be described later.

This form of buffer storage unit has the following advantages: it requires no moving mechanical components, its volume is very small and the alphabetic printing can begin as soon as the keyboard is struck. The operator can thus see what is being printed with no delay.

Cs Mm — Combination of a syllabic keyboard with a magnetic storage unit of any type. Cases where a particular type of magnetic storage is used are given later. In all these cases, the machine can be without a printing mechanism, the storage medium serving to control a printing mechanism afterwards. This mechanism can be identical or similar to the one of a syllabic typewriter, for example, the one shown in FIG. 14, or to one of an alphabetic, nonsyllabic typewriter. It can also be totally different. It can be a printing machine of a type used in the graphic arts; for example a linotype machine (trade mark), or a photo-printing device.

Cs Mbm — Same combination as Cs Mm but in the particular case where the storage medium is made up of a magnetic tape. It has been said that in this case, the magnetic tape can advance by jumps of different lengths or by uniform jumps of just one line, the number of tracks in this case being greater.

In this latter case, the jumps can be replaced by a continuous advance of the tape, the reader reading "in passing." This last method is already used with non-syllabic, alphabetic keyboards.

Cs Mcm — Combination similar to Cs Mbm but where the magnetic tape is replaced by a magnetic card. A card is more convenient in certain cases where the text is short. This storage medium accelerates the selection of a given passage and facilitates the filing. The devices for recording and for reading can be identical to those used with a magnetic tape.

Cs Mdm — Combination included in Cs Mm but a particular case where the storage medium is made up of one or several magnetic discs. Both faces of the disc can be used successively or simultaneously The elements which produce the rotation of the discs, the recording and the reading are well-known. One can affect some particular tracks to each one of the groups of characters with a distinct printing point. In this case the devices for recording and those for reading can be adapted so that the storage can control, at a later date, the printing through a syllabic machine identical, or similar to the one described or through any other syllabic machine which prints, or which controls several characters with or without spaces, to became apparent simultaneously. It is well-known that the devices incorporating a disc storage medium enable a rapid selectings of a given part of a selecting; for example, recordings of standard paragraphs.

For the various combinations briefly described above, it did not seem necessary to describe in detail and to show by drawings the elements of each combination which are already known. What is particularly new is the combination of the syllabic keyboard with these well-known elements, the syllabic recording enabling, in certain cases, a syllabic printing.

Figure 17:
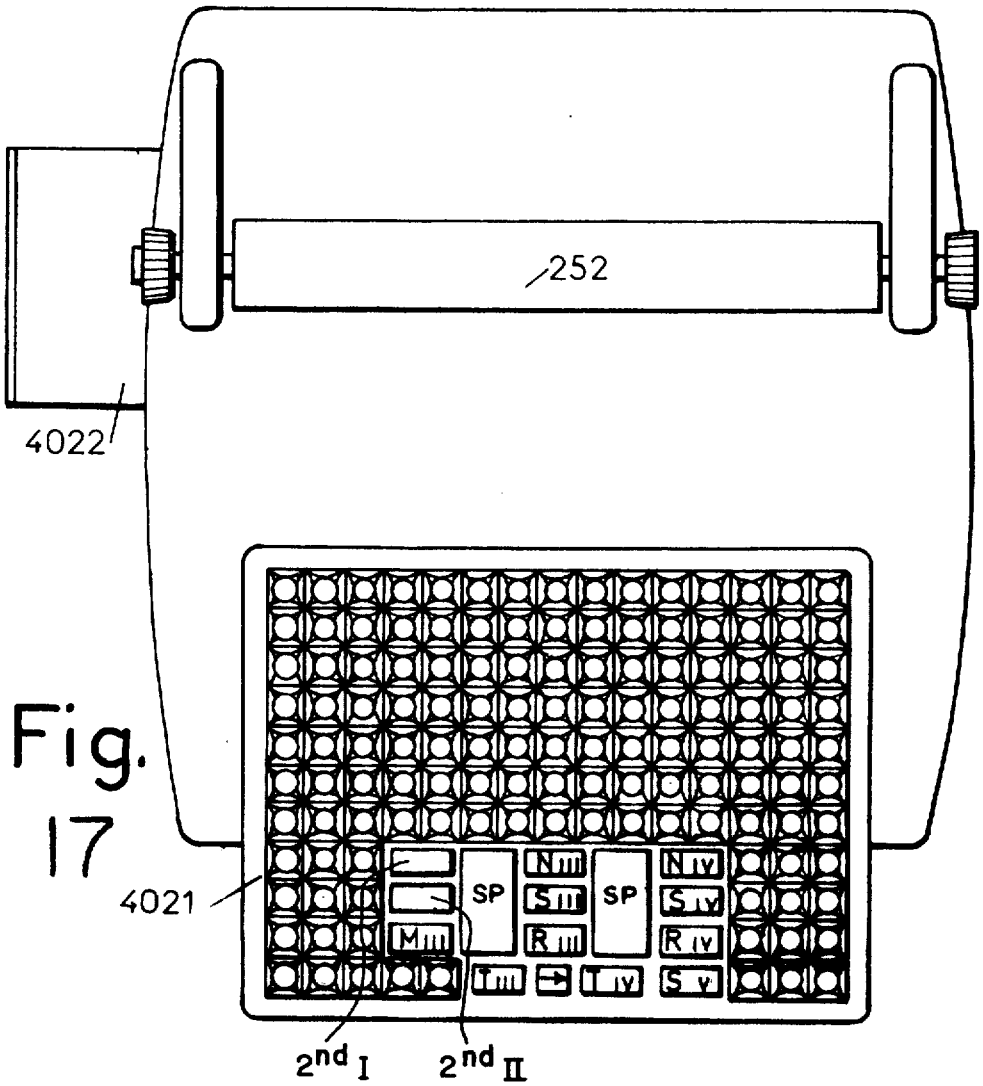
FIG. 17: Scheme of a variant of the machine that comprises the syllabic keyboard (Switchboard) combined, through the intermediary of a buffer storage unit, with an ordinary printing mechanism that only prints one character at a time and that without space. Top view.

Example of the embodiment of the combination (Cs Mbm Ia) in which a syllabic keyboard controls an alphabetic, non-syllabic, printing mechanism, through a buffer storage unit comprising a magnetic tape Such a machine is shown schematically in a top-view in FIG. 17.

Figure 15:
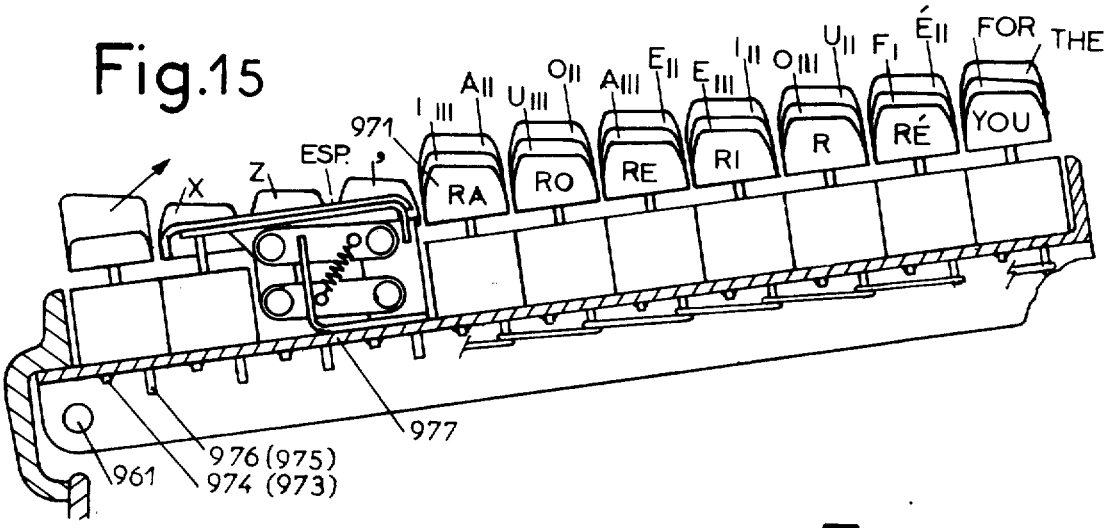
FIG. 15: Variant relating to the shape of the keys, the arrangement of the keyboard switches and the shape of their support.

It comprises a syllabic keyboard, for example, identical or similar to one of those shown in FIGS. 7, 8, 16 and 20. This keyboard is fitted with electrical connections shown in FIGS. 13, 15 and 14, up to and including the connecting bar 986 FIG. 14. At the outputs of this bar connected electric wires, each one positioned and installed so that its other extremity be connected to the inputs of a magnetic recording head, 4001 (FIG. 18). through coding matries (FIG. 23) This magnetic head comprises devices of a type already well-known, normally used for recording on magnetic tape, but instead of having only one line of these elements, this head comprises on line of such elements for each group of characters I to V which are included in the keyboard which have been described in the copending application Ser. No. 502,188, plus a line for the spacing (Sp.) The magnetic head is disposed, in a well-known manner, on the magnetic tape 4002 and covers six recording lines. If a tape with eight tracks is used, the head comprises lines of at least eight recording elements, each one situated on one of the tracks as is usual.

Each line of elements for recording corresponds to a transversal recording line on the tape and the distance between centers of the successive lines of the elements corresponds to the distance between centers which must be presented by the lines recorded on the tape. The order of the lines of the recording elements in the opposite direction to that of the tape advance, is the following: Sp. I, II, III, IV, V. Paradoxically, the recording line for the spacing is situated in front of those corresponding to the characters, whereas in the text, the spacing must follow the characters which may be controlled at the same time as the space. This is because, when the spacing is controlled, by striking the keyboard at the same time as some characters are struck, the length of the jump of the tape includes an additional line, without recording. After the jump, this available line is under the recording elements corresponding to the spacing but the recording of the spacing code is only realised after this jump.

The endless loop magnetic tape, 4002, is mounted on two drums 4003 and 4004 (FIG. 18) equipped with pins which drive the tape. The drums 4005 and 4006 press the tape against the drums 4003 and 4004 respectively. The recording head 4001 is positioned above the drum 4003. A reading head 4007, of usual type, comprising reading elements in one single line, is positioned on the tape, but close to the drum 4004. This reading head is shaped so that its lower part 4008, which is rounded, serves as a guide above the tape between the drum 4003 and the drum 4004 and rejoins the lower part of the recording head 4001 which has the same function on the periphery of the drum 4003. When at rest, that is, when typing is stopped, the tape is positioned against the lower rounded part of the reading head. It is shown in this position by the heavy continuous line. A free rotating drum 4009 limits the rise of the lower part of the loop when it reaches the position indicated by the dot-dash line. This drum is mounted on a shaft which is supported by a lever 4010. This lever is mounted free to pivot on a shaft 4011. It is drawn back by a spring 4012. Its rise controls a microreverser 4013. Its descent is limited by a stop 4014.

The arrows show the direction of rotation of the drums and of the looped tape. The reading head is completed by a decoder 4024 (shown diagrammatically in FIG. 18). This decoder controls a non-syllabic printing mechanism 4025.

The recordings on the tape are realised simultaneously by the pulses which the keyboard sends through the coding matrices (FIG. 23) to the recording head 4001 (FIG. 18) for all the characters typed simultaneously. The advance under the recording head is effected by jumps of varying length. The advance under the reading head is realised in jumps of a single line or continuously at the cadence or speed which the non-syllabic printing mechanism can accept. This latter tape advance is obtained by traditional means which are old and well-known. The result is that, after every group of simultaneous recordings corresponding to several characters with or without spacing, the recording is in advance, in relation to the reading. Furthermore, when several successive words are particularly easy to type on the keyboard this advance increases during 1 or 2 seconds.

With the keyboard shown in FIG. 8, composed for the English language, this would occur if, for example, the operator types "this man was in Canada for you." The result is that each time such a case occurs the length of tape between the place of recording and that of reading increases. The tape therefore forms a free loop between these two points and the lower part of the tape decreases to the same extent. If the advance increases too much, the tape meets the drum 4009 and raises it. The lever 4010 acts on the lever of a micro-reverser 4013 which cuts the feed circuit and engages a luminous and audible signal. At the limit, the tape takes up the position shown by the dot-dash line. The advance can reach this limit in the event of an accidental stop in the reading.

The signal stops and the current to the keyboard is re-established, by the descent of the lower part of the tape, as soon as the advance of the recording, in relation to the reading, has decreased sufficiently.

The jump, of varied length, of the tape after each recording or group of simultaneous recordings, that is to say, the corresponding rotation of the drum 4003 (FIG. 18) may be obtained and controlled by a wheel with mobile cogs which may be combined with an escapement anchor. This wheel and anchor are identical to those used to control the advance of the carriage in the syllabic machine (FIG. 14) as described in the copending application Ser. No. 502,192.

Figure 19:
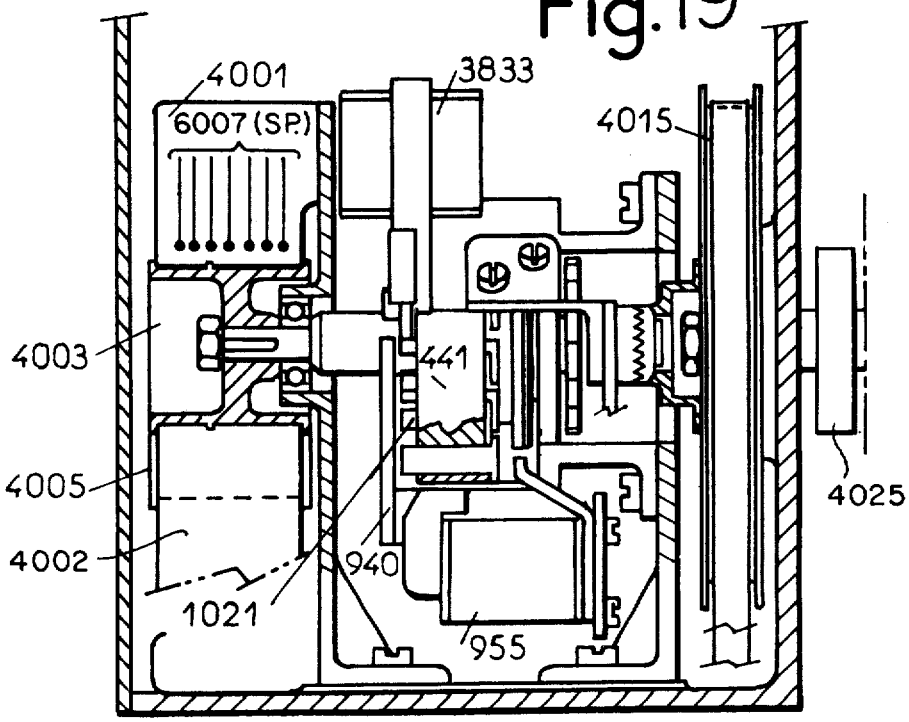
FIG. 19: Escapement mechanism controlling the forward movements of the magnetic tape by differentiated jumps, in the variant shown in FIG. 18; these jumps being produced by a cogged wheel combined with an escapement anchor. Front view.

FIG. 19 shown, in a front view, the whole of this device. It includes: an escapement wheel shown in FIGS. 2 to 6 the drum 4003 (FIG. 19) of which the shaft is made up of an extension of that of the wheel, and a driving element 4015 which tends to rotate the wheel, this shaft and the drum 4003 for each escapement, and therefore advances the tape. In FIG. 19, this driving element consists of a spring drum 4015, similar to the one for advancing the carriage in a typewriter. The spring is re-stretched, either by permanent adjustable friction on a driving element 4025 diagrammatically shown, or by automatic engagement on this driving element, or by an electric motor which is engaged automatically. Such driving means are old and well-known. The second exists for example in the electric typewriters manufactured by I B M Corporation and sold under the trade mark "Selectric."

Escapement mechanism for the forwards movement of the tape by jumps whose lengths are proportional to the number of codes simultaneously recorded.-Summary of the principles of escapement The escapement mechanism comprises essentially a cog-wheel of which, each cog can be displaced, in relation to the wheel, from a "stop-position" to an "escapement position." This mechanism comprises also a mobile stop which, in its rest position, called stop-position, is in the path of movement of those cogs of the wheel that have not been put into escapement position. This stop can be put into a second position, called the escapement position in which the cogs do not come up against it even if they are in their stop-position.

In order to obtain an escapement corresponding to one or several transversal lines on the tape, one or several cogs are displaced by electro-magnetic means that will be described.

An escapement of a single interval corresponds to an advance of the tape which corresponds to the distance between two successive transversal lines on the tape in which codes are recorded.

To obtain an escapement of one single interval or to increase by a single interval the escapement that corresponds to the recording of one or several characters codes, the stop is made to move to its escapement position.

Description of the escapement wheel

The localization of the wheel is shown in FIG. 19. In this view the wheel is mounted on a prolongation of the axle of the drum 4003 (FIG. 18) which is horizontal. In the other Figures the wheel is shown with its axle positioned vertically. The wheel itself is shown: in a front view of FIG. 2, from below in FIG. 10, from above in FIG. 12, and from the right hand side (in section) in FIG. 3.

In this embodiment, the assembled wheel comprises 16 identical mobile cogs 1021 (FIGS. 3 and 2) disposed in 16 slots at the periphery of the body 1020 of the wheel. They are parallel to the axis of rotation of the wheel and equidistant. From the outside, all the cogs are held in the slots by a ring 441. Each cog has two preferential positions and can slide from one to the other. In a first solution (FIG. 4) it is held in each of its two positions by a positioning-spring 415 and by a positioning-ball 416 that is pushed by the spring. In the escapement position, the ball is in a positioning-notch such as 417 made in the cog. Each spring is situated, with its corresponding ball, in a cylindrical hole 414 pierced in the body of the wheel.

In a second solution (FIGS. 2 and 3) each cog has a notch 423, which replaces the notch 417 and is situated on the side opposite to the axle of the wheel. The barrel 1020 of the wheel has a flange 443. The upper edge of the ring 441 is situated at a slight distance from the flange 443. Between this flange and the ring is placed a ring-spring 442 whose diameter is equal to the distance between these parts. The two ends of this spring are hooked to one another so as to constitute an elastic ring. This single spring, therefore, presses on all the teeth. When one or several of the cogs are put into its escapement position the spring contracts in the notch 423 of each of these cogs. This solution it less expensive than the preceding one.

In these figures, the top position of each cog is its escapement position. The bottom position is its stop-position. The barrel 1020 (FIG. 3) of the wheel has a prolongation 422 in the shape of a crown that stops each cog when it arrives in its escapement position. The upper part of each cog (FIG. 2) is folded back. It is blocked against the barrel of the wheel when the tooth is moved into the stop-position. Where the shifting of the escapement is made directly by an electromagnetic field (FIGS. 11-12), this bent augments the efficiency of the magnetic field.

The escapement wheel so assembled is mounted, free to rotate on a support 1055 (FIGS. 2 and 3) by means of two ball bearings 51 and 52 (FIG. 3) fitted on to the axle 1068 of the barrel 1020 of the wheel and embedded in the support 1055. This support is attached by screws to the frame of the device.

The drum 4003 (FIG. 18) on which is the tape 4002 is continually drawn to rotate in the direction of the arrow by a main spring 4015 (FIG. 19).

A toothed crown 77 (FIGS. 2 and 3) is mounted free to rotate on the axle 1068 of the wheel, which is also the axle of the drum 4003. The crown is fixed on the drum.

The crown 77 is linked with the wheel, unilaterally, by its teeth 98 (FIG. 2) which are normally engaged with the teeth of another toothed crown 99. The latter can slide backwards and forwards on the axle 1068 (FIG. 3) but cannot turn without it, because at this point the axle and the hole in the crown are square in section. The mobile toothed crown 99 is held engaged with the crown 77 by a compressing-spring 100. This spring is leaned on a ratchet-wheel 1106 that is an integral part of the axle 1068. A pawl 107 (FIG. 3) whose axle is situated on the support 1055 of the wheel, is pushed against the ratchet-wheel by a plate-spring not shown, which is fixed to the support 1055. This ratchet-wheel and this pawl prevent the escapement wheel from turning in the reverse direction if the drum turns in this direction.

The cogs of the wheel 1021, in their stop-position (FIGS. 2 and 3), extend beyond the body 1020 of the wheel beneath. When the wheel turns with the drum 4003 (FIGS. 18 and 19), each cog in stop-position comes up against a mobile stop 3018 (FIG. 5), but the cogs that have been put into their escapement position, that is to say against the crown 422 (FIG. 3) of the wheel-barrel, do not encounter this stop 3018.

A fixed cam 1120, (FIG. 2), in the shape of a spiral, lies in the path of movement of the upper parts of the cogs that have been put in the escapement position. At each turn of the wheel, this cam pushes these cogs in their stop-position for the next turn. This cam is fixed under the support 1055 of the escapement-wheel.

Description of the escapement anchor

Figure 5:
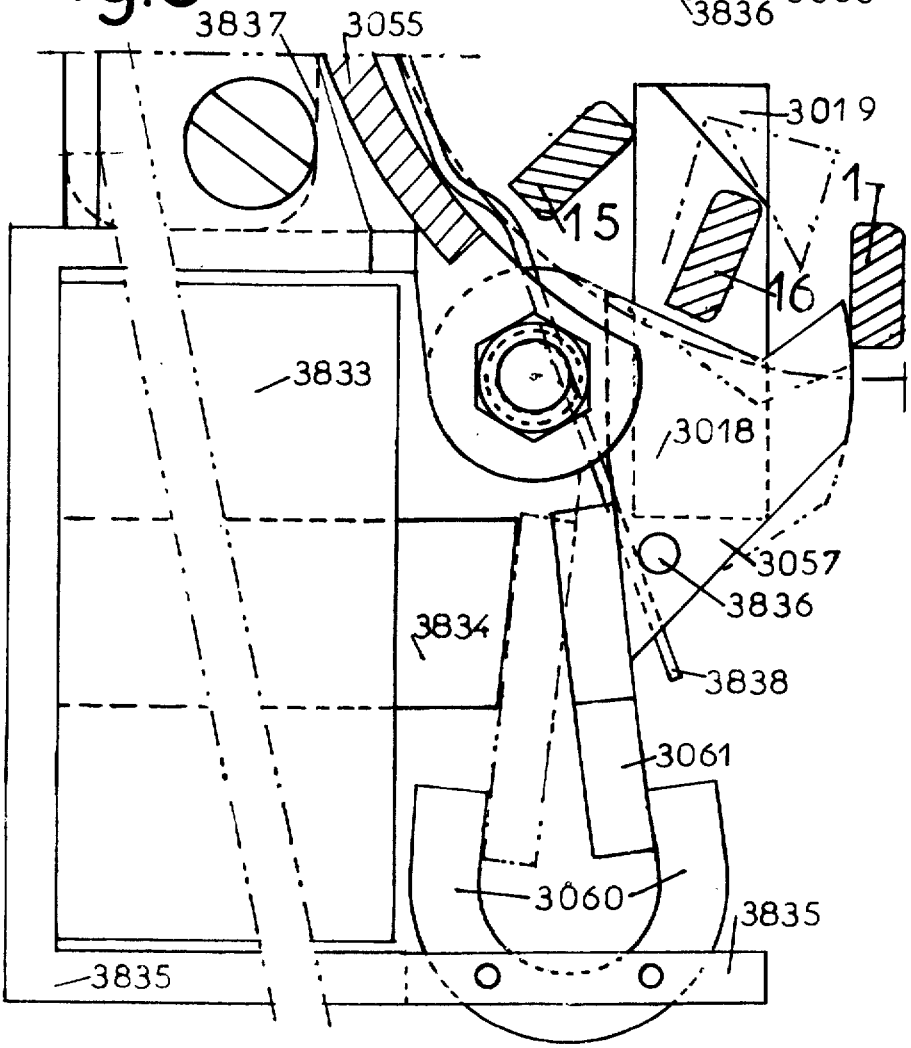
FIG. 5 Escapement anchor. Variant actuated by an electromagnet. Top view enlarged.

It has been seen that the wheel with movable cogs is stopped by a stop 3018 (FIG. 5). It is advantageous to make possible to obtain a spacing following the character, or group of characters, corresponding to simultaneously depressed keys, and this by striking at the same time on a normal spacing key, and that this spacing key be the same whatever the group, or groups, to which the characters in question belong. A means to obtain this possibility is that the stop of the escapement wheel be movable. This stop is constituted by the extremity 3018 of one of the two branches 3018 and 3019 of an escapement anchor 3057 (FIGS. 5 and 6) This anchor is similar to the escapement anchors used in watchmaking, but has new characteristics. The other branch 3019 of the anchor is the "return branch." Its function will be described later.

The anchor 3057 has two preferential opposed positions in relation to an equilibrium point. The first, is its rest position (FIG. 5) which is the stop-position. The second, (dot-dash lines) is its escapement-position. In order to pivot from one to the other the anchor is mounted on a shaft. The anchor may be provided with a spring which pushes it toward one or other position immediately after it is beyond its equilibrium point. This means which is old and well-known is not shown.

The same effect can be achieved by a permanent magnet 3060. The anchor 3057 has a shank 3061 which is drawn by the nearest of the two poles of the permanent magnet 3060 when it has pass the equilibrium point. The magnet thus help the final part of the movement of the anchor and then it olds the anchor in the considered position. In addition, the magnet constitutes a double stop.

The anchor axle is fixed on the support 3055. The upper end of this support constitutes the lower part of the support 1055 (FIGS. 2–3) of the wheel.

The movement of the anchor into escapement position its controlled by either of the two spacing keys "Esp." or 37 Sp." (FIGS. 7,8,16 or 20). It will be explained later that, moreover, certain character keys are provided with means for obtaining an automatic spacing.

Working of the escapement anchor and of the device that controls it

When the anchor is in stop position (FIG. 5), its stop branch 3018 lies in the path of movement of those of the cogs of the escapement wheel which are themselves remained in stop position. The anchor thus stops the wheel by stopping the first of these cogs. On the contrary when the anchor is in escapement position (dot-dash lines) its branch 3018 is not on the path of movement of any of the cogs of the wheel; it stops thus neither those in stop position, nor those in escapement position. On the contrary, in this position, its return branch 3019 lies in the path of movement of the cogs which are in stop position.

The anchor is moved from its stop position into its escapement position when either of the two normal spacing keys is struck. In this case, the key Esp. or Sp. (FIGS. 7,8,16 or 20) that has been struck shifts the anchor 3057 (FIGS. 5 and 6) from its stop position into its escapement position by electric connections and the electromagnet 3833, 3834.

When the anchor has thus been put into escapement position, the first of the cogs that are in stop position and arriving near the stop 3018 do not encounter it and move beyond it. But it encounters the cam constituted by the inclined edge of the return branch 3019 of the anchor and its pushing restores the anchor in stop position. As a result, the stop 3018 lies once again in the path of movement of the cogs in stop position. It thus stops the second of these cogs.

The combination of the anchor with the wheel with mobile cogs allows to increase the amplitude of the escapement corresponding to the number of characters assigned to the keys depressed simultaneously, this by striking one of the two spacing keys at the same time as striking one or more character keys. If the anchor is put alone into motion by striking one of the two spacing keys, the anchor admits the passage of one single cog and the result is only a spacing of a single interval. Designation of the places that can be taken up by a cog on the circumference of the cog-wheel and the action exercised on the cog at each of these places.

There are 16 cogs and 16 places numbered 1 to 16 (FIGS. 2,5,6) starting from 1 for the place which is against the stop 3018 and going in the direction opposite to the direction of rotation of the wheel. Place 16 is thus taken up by the cog which has just passed the stop. When the wheel turns, each cog moves through the 16 places. At each place it stops or does not stop, depending on the number of simple intervals which constitute the escapement made up by the striking in the different cases.

In the present embodiment, the places where a cog can be moved from its stop position into its escapement position are places 1 to 5; Their number is at least equal to the number of character groups that comprises the keyboard. A striking in group I puts the cog in place 1 into escapement position, a printing in group II puts the cog in place 2 into escapement position and so on, a printing in group V putting into escapement position the cog in place 5. It will be explain that, besides, a printing in group II places moreover the cog in place 1 into escapement position.

The cam 1120 (FIG. 2) in the form of a spiral, is above the cogs stopped in positions 6 to 9. While the wheel turns, each of the cogs that have been put into escapement position meet this cam which pushes them back into stop position for the next turn. This cam could be extended above places 10 to 15. In moving from place 1 to place 16, the first of the cogs that have remained in stop position, but which the stop 3018 has nonetheless allowed to pass, because the anchor was in escapement position, meets the return branch 3019 of the anchor and thus pushes the anchor back into stop position.

Electromagnetic control of the cogs of the escapement wheel and of the anchor

Figure 11:
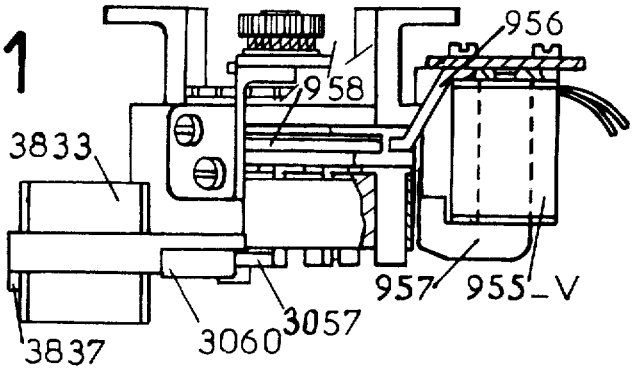
FIG. 11: Displacement of the cogs of the escapement wheel and of the anchor by electromagnets having a fixed core that pulls them directly by their magnetic field. Front view; the electromagnets I to IV being removed.
Figure 12:
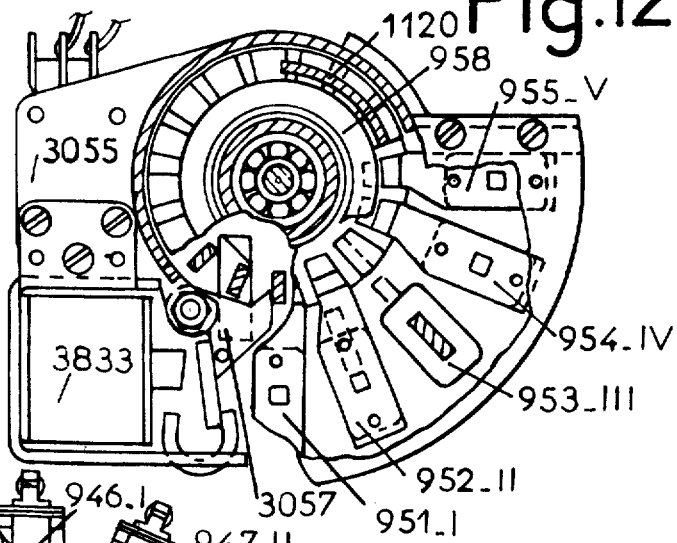
FIG. 12: Displacement of the cogs of the escapement wheel and of the anchor by electromagnets having a fixed core that pulls them directly by their magnetic field. Top view; the upper part of the wheel support being removed.
Figure 10:
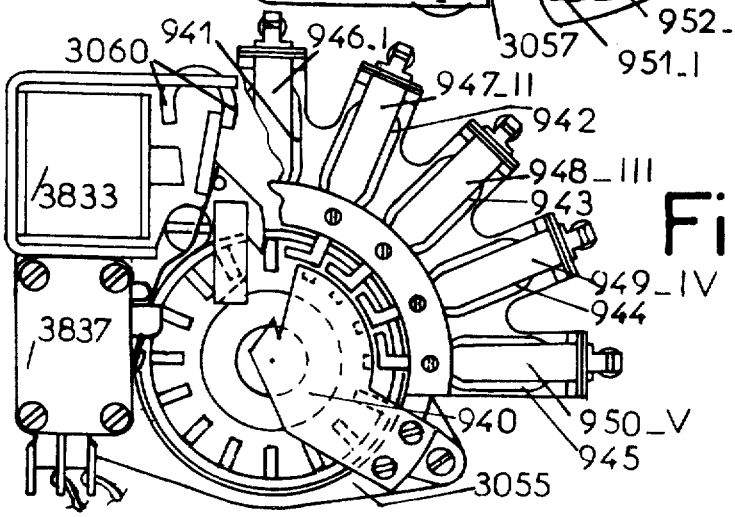
FIG. 10: Displacement of the mobile cogs of the escapement wheel by electromagnets having a mobile armature that pushes them, and actuating of the anchor by the magnetic field of another electromagnet. Bottom view.

The displacement of each cog of the escapement wheel from its stop position to its escapement position is controlled by one of the electromagnetic means shown in FIGS. 10 or 11 and 12. It has been seen that it concerns cogs situated in the places 1 to 5 (FIG. 2) corresponding to the character groups I to V and to the anchor.

In FIG. 14 in which the cog-wheel is utilized for the advancing of the carriage, the electromagnet 941 whose mobile core controls the cog which is stopped in place 1, is shown. The solution adopted here for the group I is the one shown from below in FIG. 10 and which has been explained. The cogs which are in places 2 to 5 could be controlled in an identical manner but, in FIG. 14 the solution shown to control the cog situated in the place 5 is the one in which the cog is controlled directly by the magnetic field and which is shown from above in FIG. 12 and from the front in FIG. 11

The cogs stopped in the places 1 to 4 can be controlled by the same means but the cog stopped in place 1 requires a greater force than the cogs stopped in places 2 to 5. This is because is cannot move without rubbing against the anchor. It is this which can justify the use for this cog of an electromagnet with a moveable armature (or with a plunging core), taking into account that the amount of available space is greater at this place.

Control of the cogs of the escapement wheel by electromagnets

In the embodiments that will now be described the cogs of the wheel are displaced from their stop-position to their escapement position by electro-magnetic means.

In these embodiments, the barrel (1020 FIG. 3) of the wheel and the ring 441 are made of non-magnetic material, for example in bronze.

Control of the cogs of the wheel by means of electromagnets with mobile armature Each of the cogs located in places 1 to 5 (FIGS. 2 to 6) are pushed by one of the levers 946 to 950 (FIG. 10) which make-up the mobile armature of the electromagnets 941 to 945 whose cores are placed vertically and whose coils are oval in section in order to reduce the space occupied by the whole unit. It may be seen that each of these five electromagnets are similar to those (901 and 902) used ordinarily to produce engagements of the cam on the driving cylinder in the electric typewriters (FIG. 49).

In the present embodiment the cogs can be held in escapement position by a magnetized ring, as it will be explained in the solution that follows.

Direct control of the cogs of the wheel by a magnetic field

Each of the cogs of the wheel (FIGS. 2–5) which is stopped in one of the places 1 to 5 is displaced from its stop position into its escapement position, directly by the magnetic field of one of the solenoids 951 to 955 (FIGS. 12 and 11). The cores of these five solenoids and their coils have an oval exterior form as in the preceding variant. The core 956 of each solenoid is extended above the cog on which it must act. At its other end 957 it is extended up close to the outer edge of the cog, but higher than the lower edge of the cog.

The displacement of each cog upwards is limited by the crown 958 fixed to the body of the wheel. The cog is thust stopped a short distance from the core 956 (FIG. 11) which attracts it. This crown is magnetised. It thus holds in escapement position the cogs that have been put into this position and this until such time as the cam 1120 (FIG. 2) pushes them again into stop position. Thus, one can suppress the spring 442 (FIGS. 2 and 3) or 415 (FIG. 4). If the device is built with the axle of the wheel placed vertically, each cog is held in stop position by its weight. If the machine is built with the axis of the wheel put horizontally, one adds a permanent magnet 940 shown partially in FIG. 10. This magnet is fixed on the support 3055 of the wheel (FIG. 12). Its surface extends at least beneath the cogs from place 1 to 8 (FIG. 2).

The solution above presents, in comparison with the earlier one, the advantage of having no moving parts to act on each cog. In addition it avoids the need of a return spring sufficiently strong to retract each mobile armature fast enough in order to prevent the wheel from getting stuck.

Mixed solution

In the solution shown in FIG. 14 solenoids have been used without mobile armature to retract the cogs from places 2 to 5 corresponding to the character groups II to V and an electromagnet with mobile armature has been used to displace the cog from place 1. This is justified by the fact that, in order to displace the cog of place 1, a greater amount of force is required because this cog is against the stop branch of the anchor.

Electromagnetic control of the escapement anchor

The anchor 3057 (FIGS. 5–6, 10 and 11–12) is provided with an electromagnet which has a coil 3833, a fixed core 3834, and a fixed armature 3835 which is fixed on the support 3055 of the wheel.

Each spacing key of the keyboard is connected to the electromagnet coil 3833, through the corresponding key switch.

Figure 13:
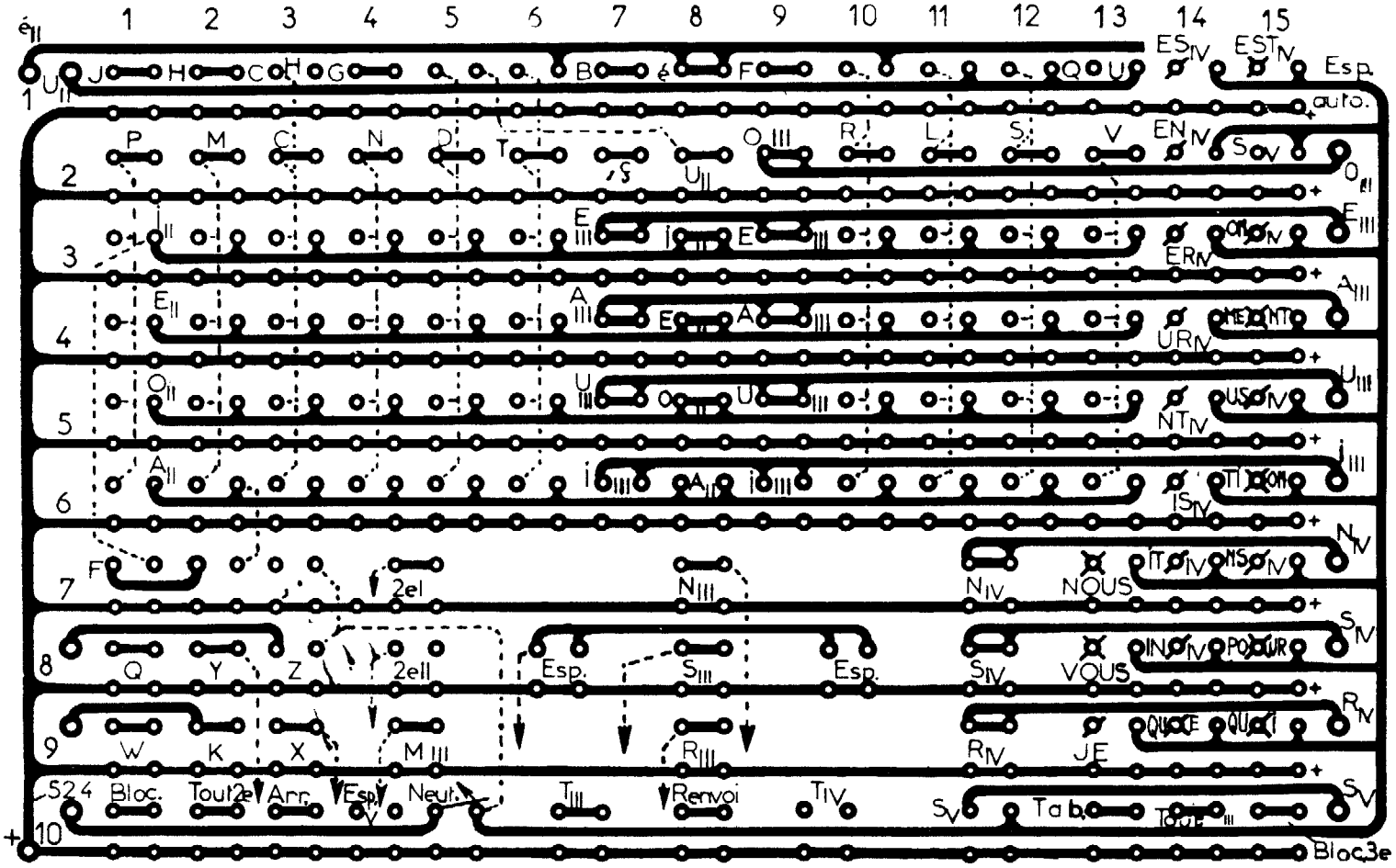
FIG. 13: The whole of the circuits that correspond to the keyboard made up of switches that each close two circuits. Part situated under the switches and which constitutes a printed network. Top view.

The character keys to which are assigned an automatic spacing (for example TION, NT) are connected to a common line (Esp. as shown in FIG. 13 for the keyboard of FIGS. 7. This line is connected to the coil 3833 of the electromagnet. The keyboard (FIG. 7) comprises a key "Neut. Esp." with a switch for cutting off the line Esp. This key permits to neutralize the automatic spacing for the said character keys.

Integration of spacing by means of a "transposition"

The escapement anchor 3057 (FIGS. 5,6 and 12) associated with the escapement wheel, that may be utilized to control the advance by differentiated jumps of a tape which constitute a memory medium (FIGS. 18 and 19) has a first function, which is to control an escapement of one single interval when a space key is struck alone, and a second function which is to increase by one single interval, the total escapement when such a key is struck at the same time as one or several character keys.

If the anchor is suppressed and its stop 3018 is replaced by a fixed stop, the first result is obtained by putting the cog which is in place 1 in its escapement position, through each spacing key, and it is possible to obtain the second result by making each spacing key realise, in addition, what will be called a transposition.

This transposition consists of displacing the assembly of elements through which the character keys control the placing of the cogs in escapement position, in such a way that the characters of group I control the cog in place 2, that those in group II control the cog in place 3, and so on, the characters of group V controlling the cog situated in place 6. The cog in place 1 is always controlled by each spacing key as well as by each character key to which an automatic spacing is moreover assigned.

The transposition, completed by the action of the spacing keys and by the character keys to which an automatic spacing is assigned on the cog in place 1, has therefore the effect of displacing one more cog than would have been displaced by the striking of the characters only. It suffice then that this transposition is effected by depressing each spacing key or each character key to which an automatic spacing is assigned.

Example of embodiment

When the cogs of the wheel are placed in the escapement position through electrogmagnets, as in the embodiment shown in FIGS. 11 and 12, or in the embodiment of FIG. 10, the device which realises the single spacing or the integration of spacing by transposition, is very simple.

An electromagnet VI, 1000 (scheme of FIG. 22) is added to control the cog in place 6. It is identical to the electromagnets I to V (951 to 955 in FIG. 12 or 946 to 950 in FIG. 10). The electromagnet 3833 (FIG. 10) which controlled the anchor, and the anchor 3057 (FIGS. 5,6 and 12) are suppressed.

Figure 22:
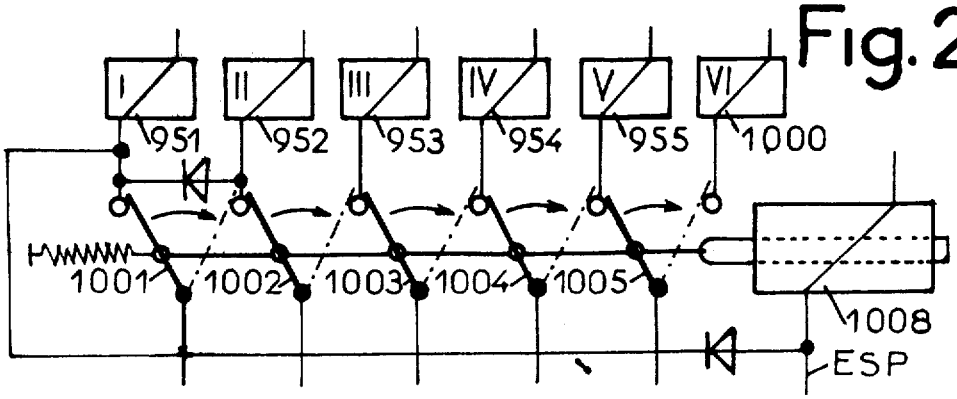
FIG. 22: Integration, through a transposition, of the spacing in the escapement, by means of an electromagnetic relay. Scheme of the device. (This device may replace the escapement anchor).

The device includes an electromagnetic relay 1008 of traditional type (scheme of FIG. 22) which comprises five contact-blades, 1001 to 1005, each one of which ensuring a rest-contact and a work-contact. The line Sp (FIG. 13) instead of being connected to the electromagnet 3833 (FIGS. 10 and 12) which is suppressed, is connected to the relay 1008 (FIG. 22).

At rest, the five contact-blades of this relay ensure, respectively, the connection of the electromagnets I to V which control the cogs in places 1 to 5. The striking of any spacing key or key with automatic spacing therefore puts this relay in circuit. In this case, that is, in word position, the contact-blades then ensure, respectively and in order, the connection of the electromagnets II to VI. The striking of each character in group I then controls the cog in place 2, the striking of each character in group II controls the cog in place 3 and so on, the striking of a character in group V controlling the cog in place 6. The transposition described above is therefore realised. But, for the escapement to be produced, it is necessary, in addition, that the cog in place 1 be placed in the escapement position by the electrogmagnet I, 951, even when the striking of a space has produced the transposition. This result is obtained by the connecting electric line fitted with a diode which connects the line Sp. with the feed line of the electromagnet I, 951.

If a space is struck thus producing a transposition, and, at the same time, a character of group II is struck without striking a character in group I, the contact-blade 1001 feeds the electromagnet II (952). Now, to produce the escapement, the cog in place 1 must be placed in the escapement position by the electromagnet I (951). For this, the conductor which ends at the electromagnet 952 (FIG. 12) or 942 (FIG. 10) which controls the cog in place 2, is connected, with a diode, to the conductor which ends at the electromagnet I (951 or 941) which controls the cog in place 1 (FIG. 22). This latter connection already exists and it was already required for the same case in the solution where an escapement anchor is used.

Figure 6:
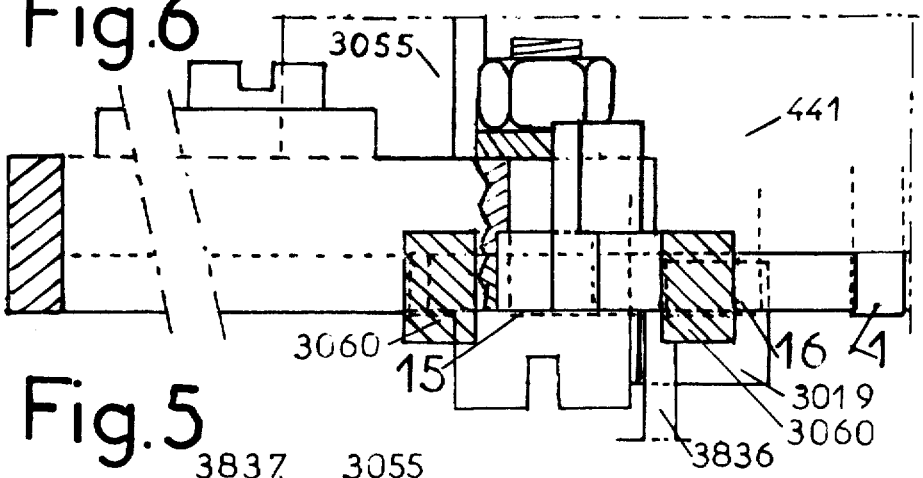
FIG. 6: Escapement anchor. Same variant as in FIG. 5. Front view enlarged.

In short, when a punched or magnetic tape is utilized as memory medium (FIG. 18), and that to obtain differentiated jumpwise advancings an escapement wheel provided with mobile cogs (FIGS. 2–4), the "transposition" device just dscribed (FIG. 22) may replace the escapement anchor (FIGS. 5 and 6).

The entire syllabic typewriter which is described in the copending Application 502 188

Such a typewriter is shown in FIG. 14 because certain parts of this typewriter are identic or similar to that utilized in the present Application. The keyboard and its output electric lines are the same, up to the connecting bar 986. The escapement wheel utilized for advancing the carriage is the same as that utilized here to advancing the tape.

Working of the escapement mechanism in the different cases

The toothed crown 98 (FIG. 2) is fixed on the same axle as the drum 4003 (FIGS. 18 and 19). This axle, and then the escapement wheel, tend to turn under the action of a spring box 4015. The cog stopped in places 1 to 5 are in stop position (FIG. 2). The cog stopped in position 1 is against the stop branch 3018 of the anchor 3057 (FIGS. 5 and 6). This anchor is in stop position. Therefore the wheel cannot turn, neither the axle nor the drum, and the tape 4002 (FIG. 19) can not advance.

It is starting from this situation that the working of the escapement mechanism in each particular case will be explained.

Figure 23:
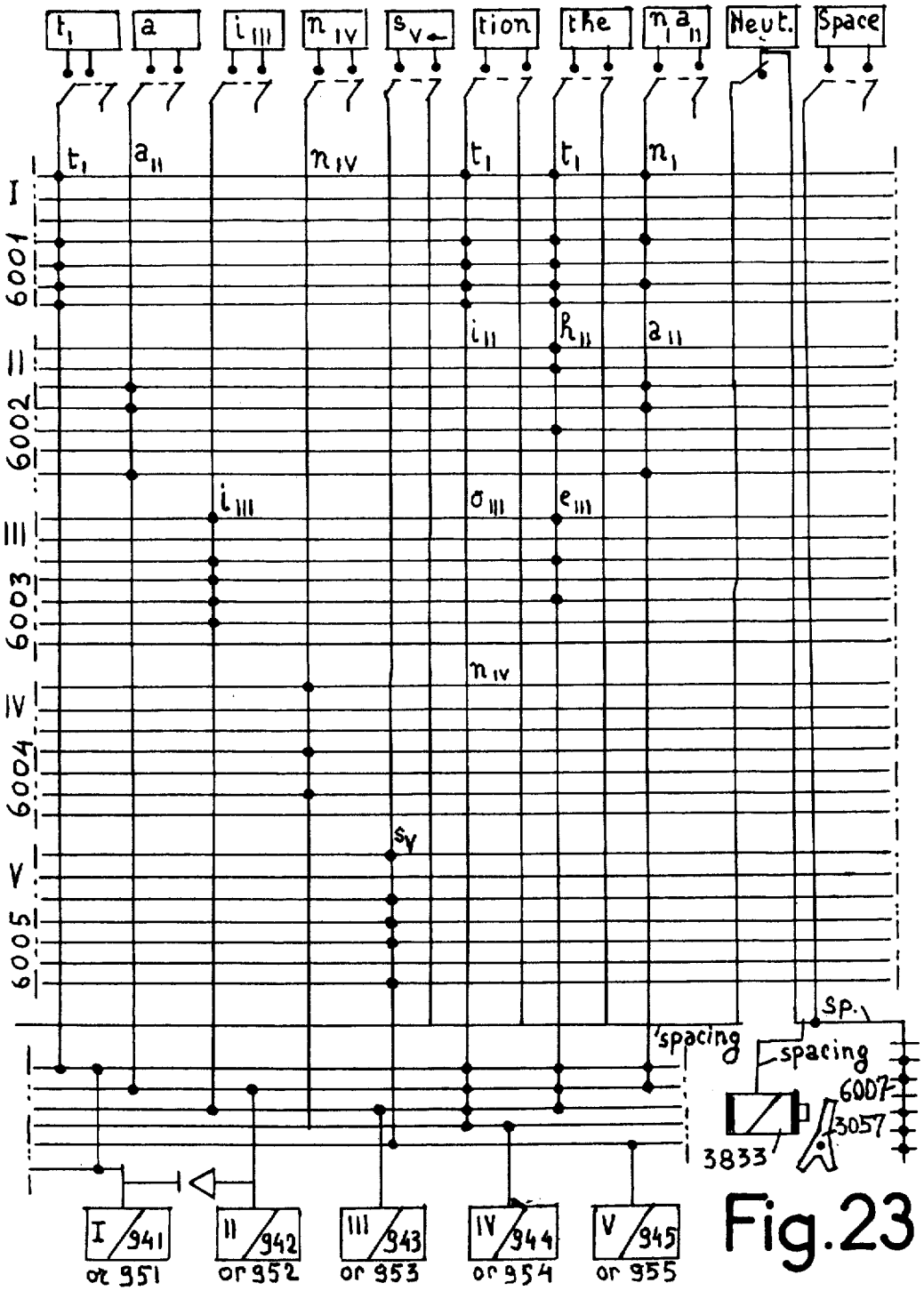
FIG. 23: Coding matrices connected between, on one hand, the keys, and on the other hand the recording head (FIG. 18), the electromagnets which actuate the escapement cog-wheel and the escapement anchor.

FIG. 23 shows diagrammatically the electric connection lines between, on one hand, the keys and on the other hand, the recording head 4001 (FIG. 18) on the tape 4002, the escapement cog-wheel and the electromagnets (FIGS. 10,11,12 and 19) which actuate the escapement anchor.

FIG. 23 shows keys for different cases by way of example only. In order to simplify, the character key switches are all double-pole switches. The keys and their respective assignements correspond to the keyboard shown in FIG. 8. FIG. 23 shows the five coding matrices 6001-6005, which are identic to that utilized in an other embodiment in which the storage unit is electronic and which are shown 5001–5005 in FIG. 21.

The electromagnets 941–945 (FIG. 10) or 951–955 (FIGS. 11, 12 and 19) are that which control the cogs of the escapement wheel which are in the places 1 to 5 respectively (FIG. 2); these places corresponding to the character groups I to V respectively.

The electromagnet 3833 is that which actuates the escapement anchor. It is shown with the anchor 3057.

The different output lines of each coding matrix are connected to the corresponding elements of the recording head 4001 (FIG. 18). In each line (Sp., I, II, III, IV, V) there are as many elements as there are bits in the adopted general code, each element being above one of the tracks on the tape. (For example, seven elements). The elements corresponding to the matrix 6001 which correspond to character group I are connected to the recording elements in line I of the recording head. Those of matrix 6005 corresponding to character group V are connected to the elements in line V of the recording head.

The spacing electric line (FIG. 23) is connected to the electromagnet 3833 which actuates the escapement anchor 3057. In addition, a prolongation of the spacing line (Esp. FIG. 13) is divided in several lines (FIG. 23) to constitute the spacing matrix 6007 and are connected to the elements in the line SP. in the recording head 4001 (FIG. 18) to generate the code of the spacing. The prolongation of the spacing line is a delay line.

In FIG. 23, the different spots show the different connections between the electric lines. Each of these connections is made through a diode which is not shown.

First Case

Striking on one single key to which is assigned a character of group I, without spacing In the example, this character is $t_I$. By the depressing of the key, the key switch generates a pulse. This pulse generates in matrix I, 6001, the code corresponding to $t_I$. The corresponding bits are transmitted in the corresponding recording elements in the line I of the recording head (FIG. 18). The recording elements record the bits in the corresponding tracks of the tape. The recording elements are punchers if the embodiment utilizing a punched tape. They are magnetic elements if the tape is a magnetic tape. Those shown in FIG. 18 are magnetic recording elements.

The pulse generated by depressing of the key is also transmitted to the electromagnetic 941 which shifts the cog of the wheel in place 1 (FIGS. 10 and 2) from its stop position to its escapement position.

The cog in place 1, having escaped from the stop branch 3018 (FIG. 5) and no longer stopping the wheel, this latter starts to turn with its axle and with the drum 4003 (FIGS. 18 and 19) until the cog that was in place 2 is stopped by the stop branch 3018. The cog in place 1, after having passed the stop, is then at place 16. The tape has thus moved by a single interval and this corresponds to the recording of the character of group I which has just been effected. The recording is more rapid than the movement of the wheel and of the tape, because the inertia. It results that the advancing of the tape occurs after the recording.

Second case

Simultaneous striking of a character of group I and of a character of group II, without spacing Among the examples shown in FIG. 23, there may be the depressing of key $t_I$ and key $a_{II}$ simultaneously. The effect of depressing key $t_I$ is the same as in the first case. In addition, the depressing of key $a_{II}$ sends a pulse which generates the code corresponding to *a* in matrix II, 6002, the bits of which being transmitted in the corresponding recording elements in line II of the recording head 4001 (FIG. 18). The bits are recorded in the corresponding tracks of the tape in line II, in the same manner as for $t_I$ in line I. Moreover, the pulse generated by the key switch $a_{II}$ is transmitted to the electromagnet 942 which shifts the cog in place 2 from its stop position to its escapement position. The wheel turns by the effect of the striking of $t_I$, as in the first case, but the cog in place 2 being also in escapement position, the wheel continues to turns until the cog which was in place 3 is stopped against the stop 3018. Thus, the rotation corresponds to an advance of the tape by two intervals, which correspond to the recording of the two characters $t_I$ and $a_{II}$.

FIG. 23 shows that the same advance of the tape is obtain by depressing of the single key *na*.

Third case

Simultaneous striking of more than two characters, one of group I and the other of several adjacent higher groups, without spacing It is supposed here that none of the character groups the rank of which are inferior to that of the rank of the highest group wherein a character is printed remains without printing.

For example, the keys $t_I$, $a_{II}$ and $i_{III}$ are struck simultaneously when the word "maintaining" is struck.

The striking on the keys $t_I$, and $a_{II}$ have the same effects as in the second case. In addition, by the striking on the key $i_{III}$, the corresponding key switch sends a pulse which generates the code corresponding to *i* in the matrix 6003 of group III. The bits are transmitted in the recording elements of the recording head 4001 (FIG. 18) in line III. The code is then recorded in the corresponding transversal line of the tape. The pulse is also sent (FIG. 23) in the electromagnet 943 which shifts the cog in place III from its stop position into its escapement position. This cog then does not encounter the stop 3018 of the anchor (FIG. 5). The rotation of the wheel continues until the cog which was in place 4 is against the stop 3018. The rotation of the wheel and of the drum 4003 (FIG. 18) and the advance of the tape correspond to three simple intervals, which corresponds to the three recorded codes.

It is so possible to strike, simultaneously, as many characters as there are coding matrices in the device.

In the example above, the striking may be obtained with a simplier fingering, since there is a key *ta* in the keyboard. It suffices to strike simultaneously the keys *ta* and $i_{III}$.

Fourth case

Striking of a character in one, or simultaneously in several adjacent groups starting from group II, without striking any character in group I, without spacing Example: the keys $a_{II}$ and $i_{III}$ are struck simultaneously when striking the word "aiding." No character is struck in group I It is seen in FIG. 23 that the feed line of the electromagnet 942 of group II is connected to the feed line of the electromagnet of group I through a diode. The effect is that when a character is struck in the group II the cog in place 1 (FIG. 5) is also shifted from stop position into escapement position. It results that the escapement is the same as if a character is also struck in group I. In this case no code is recorded by the elements of the recording head in the transversal line of the tape (FIG. 18) which corresponds to group I.

For $a_{II}$ and for $i_{III}$ the effects are the same as in third case.

This fourth case occurs particularly when the initial letter of a word exists only in group II; for instance a vowel.

Fifth case

A normal spacing key ("Spac." in FIG. 8 or "Space" in FIG. 23) is struck without striking any character key By striking the key Space (FIG. 23), the key switch sends a pulse which excites the electromagnet 3833 which shifts the anchor 3057 (FIGS. 5 and 23) into escapement position. The branch 3018 of the anchor stop no longer the cog in place 1. The wheel turns. The cog encounters the branch 3019 of the anchor, which returns the anchor in escapement position. The cpog which was in place 2 encounters the stop branch 3018 of the anchor which stop the wheel. The escapement and the advance of the tape correspond to a single interval. In addition, the pulse sent by the key switch generates the code corresponding to the spacing, in the divided prolongation of the spacing line, which constitutes the spacing coding matrix 6007. The bits are transmitted into the recording elements of the recoding head in line Sp. (FIG. 18). The code is recorded in the tape; but the prolongation of the spacing line being a delay line, this recording occurs only after the advance of the tape.

Sixth case

Striking of one spacing key and, at the same time, one or several character keys In order to simplify the fingering, it is possible to utilize the character keys which are provided with a device to obtain characters and a space by the same key. This device has been described in the copending Application, Ser. No. 502,188.

Among the examples shown in FIG. 23, the key "tion" (which gives a spacing) can be struck alone to correspond to the sixth case.

The key switch sends a pulse which generates:

the code corresponding to "$t_I$" in the coding matrix 6001, the code corresponding to "$i_{II}$" in the coding matrix 6002, the code corresponding to "$o_{III}$" in the coding matrix 6003, the code corresponding to "$n_{IV}$" in the coding matrix 6004.

These codes are transmitted in the elements of the recording head as in the preceding cases, that is to say, in lines I,II,III,IV, and are recorded in the corresponding transversal lines of the tape.

The electromagnets 941, 942, 943, 944 are excited and they shifts in escapement position the cogs in places 1,2,3,4. These cogs do not encounter the branch 3018 (FIG. 5) of the anchor 3057. In addition, the electromagnet 3833 is excited, which shifts the anchor in escapement position (as in the fifth case). It results that the stop branch 3018 of the anchor does not stop the cog which was in place 5. The latter pass this stop branch. The stop branch stops only the cog which was in place 6. It results that the escapement and the advance of the tape correspond to five simple intervals. This code corresponding to the spacing has been generated in the divided prolongation of the spacing line, as in the fifth case, but, as this prolongation is a delay line, the bits corresponding to the spacing code are transmitted in the recoding head and are recorded in the tape, only after the tape advance.

It is seen that the result of the structure shown in FIGS. 23 and 18 is that the spacing code is always recorded in the transversal line of the tape which follows the transversal lines in which the character codes have been recorded.

From what has been described concerning the different cases, the following general rule can be formulated "If the operator strikes one or several characters in adjacent groups, simultaneously, without striking a spacing at the same time, the width of the escapement obtained is always equal, in numbers of single intervals, to the number expressed by the rank of the group whose rank is the highest among the groups in which a character is struck and if, at the same time, the operator strikes a spacing, this width is increased by a single interval."

Reading head 4007

The reading head 4007 (FIG. 18), when the tape is a magnetic tape, is of a traditional structure utilized for reading such tapes. This structure is old and well-known. It is therefore not described. It comprises as many reading elements as there are tracks, that is to say, as there are bits in the choised general code. Only its outer shape is particular. This shape is shown in FIG. 18.

When the tape is a punched tape, the reading head is also of a well-known type. It comprises as many elements to read the punched holes as there are bits in the choised general code.

Decoder

The decoder 4024 (FIG. 18) is connected to the output of the reading head 4007. It is of a traditional and well-known type. To the output of the decoder may be connected any device to obtain a permanent or semi-permanent recording or a printing. For example, the tape may control through the reading head and the decoder a printing mechanism such as that of an electric non syllabic typewriter which is provided with an electromagnet. Such typewriters are well-known and commonly owned.

As when the storage unit comprises electronic means, such as that which will be describe, the buffer storage unit described above, enables to control a non syllabic printing mechanism by a syllabic keyboard.

This printing device may be of a type having tape bars, or a printing sphere, or a printing cylinder, for example.

The connecting means between the decoder and a traditional printing mechanism or a device for obtaining a permanent or semi-permanent recording are well-known, therefore this connecting means nor the connected devices are not described nor shown.

The device shown in FIG. 18 enables to use a continuous tape when the recording is to be kept for produce printings ulteriorly. In this case, the tape is installed in the same way as the upper part of an endless looped tape on the drums 4003 and 4004 but its arrival towards the reading head and its exit after recording have their directions indicated by the arrows 4016 and 4017 (FIG. 18).

The feed device with continuous tape toward the recording place and the device for winding on the tape after reading, are conventional. They are not shown in the drawing and are not described.

Whether the tape is magnetic or punched, whether it be an endless loop or continuous the electromagnets 945–946 (FIG. 10) or 951–955 (FIGS. 11–12) which displace the cogs of the wheel and the anchor are excited by the brief contacts which are established by the keys on the keyboard as it has been described above. One sets up the electrical links which are necessary between the circuits already described and the corresponding electromagnets which control the wheel or the anchor.

FIG. 17 shows schematically the whole machine in a top view only to show that the keyboard, the buffer storage unit, and the printing mechanism, may be contained in the same machine. The syllabic keyboard 4021 is that shown in FIG. 20. This keyboard has only two case positions. The device which constitutes the buffer storage unit through the which the keyboard controls the printing mechanism is placed on the left hand side in the scheme of FIG. 17. The storage unit 4022 can be that using a magnetic tape and which is shown in FIGS. 18 and 19. The printing mechanism 4023 is that of a traditional electric typewriter. It controls the printing on the support disposed on a cylinder 252 (FIG. 17) as is usual. This mechanism is not described because it may be any of traditional types.

Placing into case position 2 and return into case position 1 — Three cases exist

1ST CASE

All the characters are printed simultaneously in 2nd case position

The operator previously depresses the key "Bold 2nd" (FIG. 8). The contact which is made produces a pulse which has the same effects by the similar structures as those previously described for the case of a character of group I. The corresponding code is recorded on the tape, in line I, the assembly of marks which correspond to the code for putting the printing mechanism in 2nd case position with locking through an electromagnet with locking. The locking is obtained either by leaving the electromagnet energised or by means of a pawl, as is conventional. The operator then strikes all the characters which are to be printed in capitals. He then depresses the key which controls the release and the return to case position 1. The contact produced records on the magnetic tape in line 1, the assembly of marks which corresponds to the coding for the locking and for the return in the case position 1, again as is conventional. This key is the one previously referred to as "Tout 2e" (All 2nd). It will be called "case position 1" or abbreviated to "pos.1."

2ND CASE

The initial letter of group I is the only one to be printed in capital, but the characters which follow and which are struck at the same time are to be printed in small letters The tape comprises a supplementary track on which the recording of bit should produce the unlocking and the return to case position 1 but such a recording is only used in the 2nd and 3rd cases.

The operator depresses the key "2eI" (2nd case position for the group I). The contact established records on the first line of the tape the same assembly as makes the key Tout 2e (all the groups in second case position) in the 1st case and which should set the printing mechanism in 2nd case position. But the same contact also records a bit in the supplementary track, corresponding to unlocking and to the return to first position, but in the line which corresponds to group II. However, the recording element which produces this mark is part of group I. It follows that these two recordings produce an advance of the tape of only one interval.

The "bit" for the first position is therefore brought on to the line of the tape which corresponds to group I.

The operator then depresses the key or keys which are to produce the recording of the characters, with or without spacing, for example "ther." The recordings which result are the same as if there were no recording for 2nd case position. On the first line therefore, is the assembly corresponding to the initial letter and the mark "bit" for the first position which was recorded by the preceding striking.

The reading head comprises a supplementary reading element which is positioned on the special track for return to the first case position. When the line of the tape in which the initial letter is recorded arrives under the reading head the printing device is already in 2nd case position (capitals). The reading head reads the assembly corresponding to the initial and, at the same time, reads the code corresponding to the unlocking. But the electric line which transmits the signal for the first case position to the corresponding electromagnet is a delay line of a traditional type. Such lines are old and well-known. The delay produced has the effect of preventing the return to the first case position until after the printing of the initial letter. The electromagnet which produces the return to the first case position is fitted with conventional means to prevent the advance of the tape during the period of time necessary for the return to 2nd case position of the device. Then the advance is realised and the following characters are printed as in the general case.

3RD CASE

Initial letter is to be typed in group II in capitals, the other characters being struck at the same time are to be printed in small letters The only difference in relation to the 2nd case just described is that the code which is to produce the return to the first case position is recorded in line III. The corresponding recording element is also part of group I. The advance is still therefore of only one interval. After the advance this mark is therefore in line II on the tape, where the recording corresponding to the initial letter of group II will be effected. The operator then strikes the group of characters, of which the initial letter must be in 2nd case position and, when required, the space (for example "En").

Adaptation of the device shown in FIG. 18 for the case where a punched tape is used, which is the combination Cs MOP Ia, already expressed FIG. 18 is a scheme which does not show the relative dimensions of the different elements. The result is that it is also valid in the case where a punched tape is used. But in this case, the tape is inevitably continuous as the erasing is impossible. The magnetic recording head 4001 is replaced by perforators which are controlled by one of the well-known devices. The reading head 4007 is replaced by devices of well-known type, normally used for reading punched tapes; for example mechanical feelers or readers using photo-electric cells. This device is completed by a decoder of well-known type. The punched tape is placed as shown in dot-dash line.

Syllabic keyboard with two case positions

When the alphabetic (non-syllabic) printing mechanism which is controlled by a syllabic keyboard comprises only two case positions, the syllabic keyboard may have two case positions only. For example, if the printing mechanism is of a type with type bars, each key corresponds to two characters located on the same type bar. If this mechanism is of printing sphere type they are the two characters which are diametrically opposed on this sphere. It is known that in typewriters with a printing sphere, each of the two positions corresponds to one of the two hemispheres of this sphere.

Figure 20:
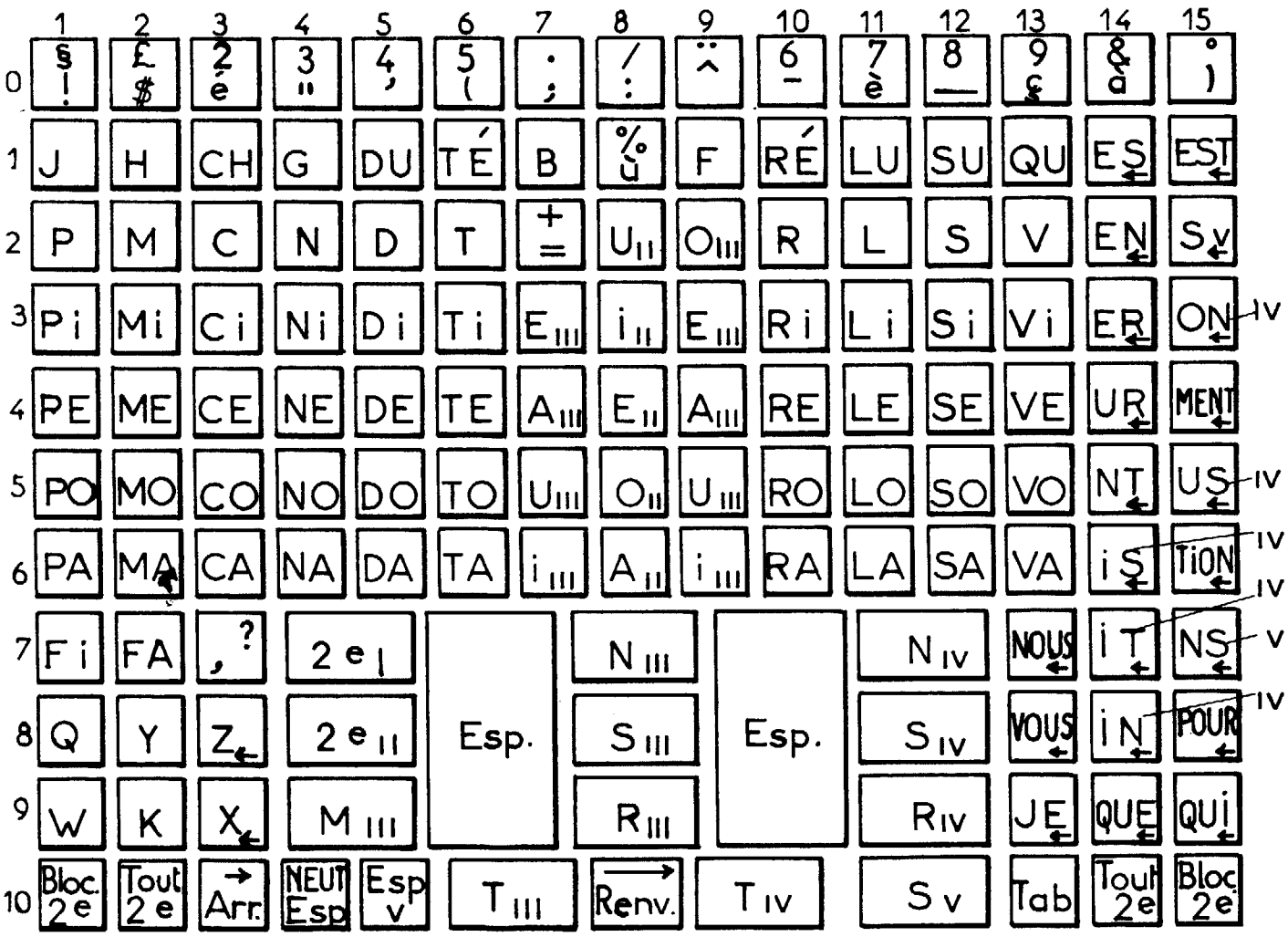
FIG. 20: Example of a syllabic keyboard with two case positions, designed for the French language.

As an example, the keyboard shown in FIG. 20 is a transposition of the keyboard shown in FIG. 7 with 3 case positions into a keyboard with 2 case positions. The only important difference between these two keyboards is that the characters which in FIG. 7 are in case 3 are attributed to the keys in a supplementary row which, in FIG. 20 is numbered 0 (zero). Some are therefore placed in case 1 and the others in case 2. Note that the layout of the keys in this row is almost the same as in the first row of the keyboard, called "Universal," of conventional non-syllabic typewriters.

Example of an embodiment of the combination Cs Me Ia in which the syllabic keyboard controls an alphabetic (non-syllabic) printing mechanism through an electronic buffer storage unit The combination comprises, connected to the exit conductors of the keyboard 4021 (scheme of FIG. 21), an electronic buffer storage unit which includes principally the following devices:

| | |
|---|---|
| - eight coding matrices | 5000 to 5007 |
| - eight shift registers (provisional memories) | 5010 to 5017 |
| - a main memory | 5021 |
| - a bit (binary digit) checker (before entry in the main memory) | 5024 |
| - a transfer interrupting device in the main memory (fitted with delay element) | 5030 |
| - an addressing device in the main memory | 5018 |
| - an auxiliary address memory | 5032 |
| - a decoding matrix | 5028 |
| - a bit checker before decoding | 5027 |
| - a device for interrupting the reading during each operation by the printing mechanism | 5031 |
| - an amplifier before each electromagnet which controls printing, spacing or a subsidiary operation (5034, which concerns the putting in 2nd case position is shown separately). | 5026 |
| - a monitor for monitoring the operations of the device | 5022 |
| - a pulse generator called "clock" | 5023 |
| - two flip-flop devices for the case shifting | 5033 and 5037 |
| The printing mechanism 5029 comprises: | |
| - electromagnets such as each one controlling a character, a space or a subsidiary function. | 5025 |
| - the shift mechanism | 5036 |
| - an electromagnet for 2nd case position (capitals) | 5035 |

The syllabic keyboard used is of one of the types already described in the copending Application Ser. No. 502,188 and composed for the language in question but adapted to have only two case positions. It is supported here that the keyboard used is that shown in FIG. 20, which is composed for the French language and which is numbered 4021 in Scheme of FIG. 21.

Striking the keys (FIGS. 9 and 14) establishes contacts which apply an electric voltage to certain conductors. These voltages constitute pieces of information (data) which must be treated by the buffer storage unit in order to control the non-syllabic printing mechanism. The number of different data reaching approximately 54, they are represented, each one, by a binary number according to a code, thus reducing the number of conductors required. The term "information (or datum)" which will be used to abreviate, represents, depending on the case, a character, a space or a subsidiary operation. The term "strike" signifies depression of a key. The term "printing" signifies printing on a sheet of paper, or the space, or the realization of a subsidiary operation.

The function to be fulfilled by the device which constitutes the buffer-storage unit is the same as in the combination Cs Mbm Ia and Cs Mbp Ia already described. It must therefore receive, simultaneously, the data which correspond to the key or keys which are struck simultaneously, code these data and memorize them, all this at the cadence of syllabic typing, then send it to the non-syllabic printing mechanism to control the corresponding operations, one by one, at the cadence at which this mechanism can function.

When using a printing mechanism which is rapid enough to enable printing of five characters in succession and, in addition, realizing a spacing, during the period of time which separates the beginning of two successive groups of simultaneous strikings on the syllabic keyboard, the buffer storage device can be more simple than the one described here. Effectively, when this condition of speed is fulfiled, the buffer storage device only needs to retain a maximum of six data corresponding to five characters and one space. However, it must receive them simultaneously and send them in succession, at the cadence of printing. Such a speed is attained and even exceeded on certain alphabetic (non-syllabic) mechanisms.

The buffer storage device can be simplified for the same reason and in the same way when the syllabic keyboard has to control, through the intermediary of this buffer storage, a second storage means, magnetic or punched, for example, which is continuous but which does not control a printing mechanism immediately. Effectively, the magnetic recording heads or the perforators can reach and even exceed the speed defined above.

In the embodiment described here, it is supposed that the printing mechanism has a lower printing speed than the one determined above but that, nonetheless, its average speed is higher than that of a good typist when typing a text, without interruption, which is easy to read and to type on the keyboard used, or when typing directly from dictation, otherwise the combined machine would not be utilizable.

This condition of average speed is fulfilled, for example, by the printing mechanism of electric typewriters using typebars and which can print at a rate of at least 720 operations per minute, which is 12 operations per second, as well as by that of electric typewriters using a printing sphere and which can achieve 900 operations per minute, which is 15 per second.

As these printing mechanisms are well-known they are not described here. In the present embodiment, the printing mechanism used is that of the typewriter manufactured by IBM Corporation and sold under the trademark 73 or that sold under the trademark "connected electric typewriter without keyboard."

Whether the mechanism uses type bars, a printing sphere or a printing cylinder, the buffer storage unit can be the same. However, with a sphere or with a cylinder, the number of electromagnets is lower than with type bars, what simplify the decoding matrix.

The means well-known in themselves and usual in the field of data processing systems, enable the realization, in various ways, of a buffer storage device which fulfils the conditions given above. What follows, therefore, is only a brief description of an example.

Conductors on the keyboard exists

The network of printed circuits (FIG. 13) has, at its outputs conductors, certain of which each corresponding to a key for a combination of characters. Each of these latter conductors is divided into several lines each and fitted with a diode. Each division then rejoins the conductor which corresponds to the character which it has to control. Finally, signals are obtained at the output of the keyboard in electric lines which may be classified into eight categories which have been described in the copending application Ser. No. 502,188, under the sub-title "Electric connections between, on one hand, the keys and, on the other hand, the electromagnets which control the printings.

In the present example the printing mechanism only includes two case positions. Therefore, to the preceding output lines which the printed network (FIG. 13) includes must be added fifteen conductors starting respectively from the fifteen keys of the zero row of the keyboard shown in FIG. 20. These fifteen keys correspond to the characters which, in the other keyboard described, are in third case position and which, here, have been placed, some in case position 1 and the others in 2nd case position.

Code

One of the usual binary codes that are utilized in data processing systems or a special code can be used. The code must have at least 46 possibilities for the characters, plus one for the spacing, one for neutralising the automatic spacing and approximately six for the subsidiary functions, giving a total of 54 possibilities.

For example, a six-bits code can be selected, adding, if desired a bit for changing the case and a bit to check the parity in order to enable a recognition of validity. An eight-bits code is thus obtained, enabling the use of elements which are usual in data processing. It is known that each bit is represented by one of two electric voltage to which the values 1 and 0 are respectively attributed.

Coding matrices

The keyboard output conductors are assembled in eight groups which end in eight respective coding matrices 5000 to 5007 (FIG. 21) and constitute the inputs to these. The first of these matrices is distinguished by a zero and the others by the roman numerals I to VII.

Each one of these coding matrices is made up of an electric network the inputs of which come from the keyboard. Each of these matrices has a number of outputs corresponding to the number of bits general code adopted. Its internal structure is such that applying a voltage at one of its inputs provokes the arrival at each of its outputs of either 1 or 0, so that the assembly of bits make up the binary number which represents the information to which the input in question is assigned. Such coding matrices are well-known.

Rule for assignment to the different coding matrices

The matrices I to V correspond respectively to the groups of characters I to V corresponding to five different printing points. The matrix VI corresponds to the spacing.

In theory, the information corresponding to a character of a given group is therefore coded by the matrix of the corresponding rank. But, this theory can be subjected to derogations.

These derogations are rendered possible by the following characteristics of the combination described here. When printing is syllabic, the separation of the characters in different groups, I to V, is effected with the object of obtaining that each of the characters be printed in the place it has to occupy amongst the characters struck simultaneously on the keyboard and printed simultaneously, the space always coming after the characters. In the present combination, on the contrary, the ranging in groups is only effected with the object of obtaining that the printing operations are ordered to the printing mechanism one after the other in the order of their respective printing points and that the spacing be ordered after the characters. It results from this that, if a given character is always to be struck alone on the keyboard and without spacing, the information which corresponds to it can be attributed for coding to any one of the I to VI coding matrices. This is one of the derogat ions to the theory mentioned. Nonetheless, for this, it is necessary that both characters attributed to the same key and which correspond in both case positions, fulfil the condition of being always struck each one alone and without a space. If it is desired to control the printing of the character in question at the same time as a space, the information which corresponds to this character cannot be generated in the matrix VI. It is advantageous to code the information corresponding to the figures in group I in the matrix I in order to allow the strike each one at the same time as a zero in each another group.

The coding of each of the subsidiary operations which are to be struck at the same time as the characters which follow it, is attributed to the zero matrix. These are: All in 2nd case position (All 2nd), Initial letter in group I, Back space, Tabulation.

The coding of the subsidiary operation that are desired at the same time as the character or as the space which precede it is assigned to the matrix VII. These are: The return to the first case position and The Return of the carriage.

When, in the keyboard used (FIG. 20) a given character exists in several of the groups I to V, the information coded is the same in all the corresponding matrices. For example, this is the case for N, S, R, T which exist in groups I, III and IV. The S also exists in group V. The number of the different data is therefore not increased by these repetitions. It will be seen that what does differentiate the effects for each of these letters, according to the group to which it has been attributed, is the matrix by which the information is coded in each case.

Register situated at the exit of the coding matrices

Figure 21:
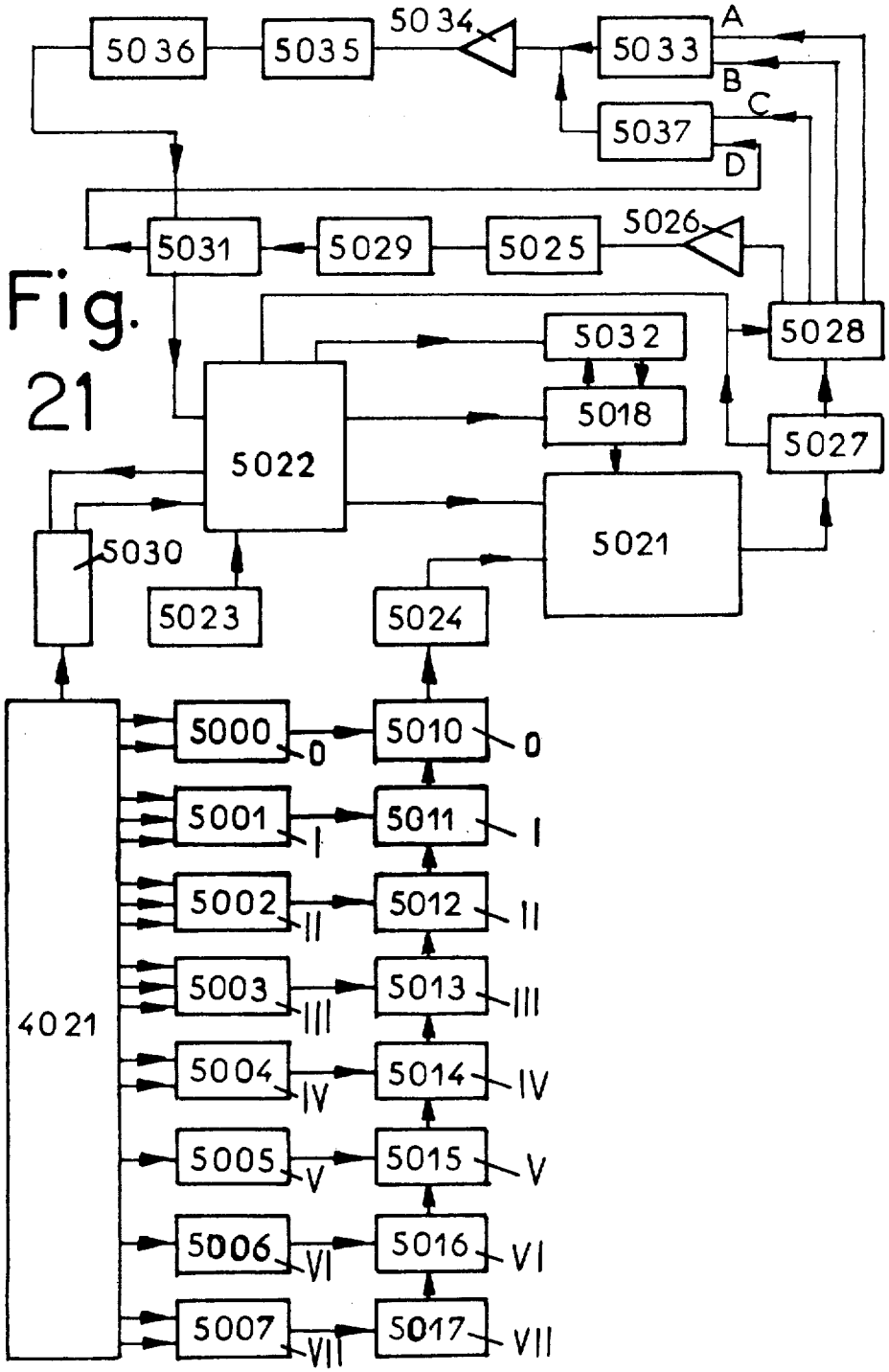
FIG. 21 comprising parts designated 21*a* and 21*b*. Scheme of the electronic buffer storage unit by means of which a syllabic keyboard controls an ordinary non-syllabic printing mechanism.
Figure 21:
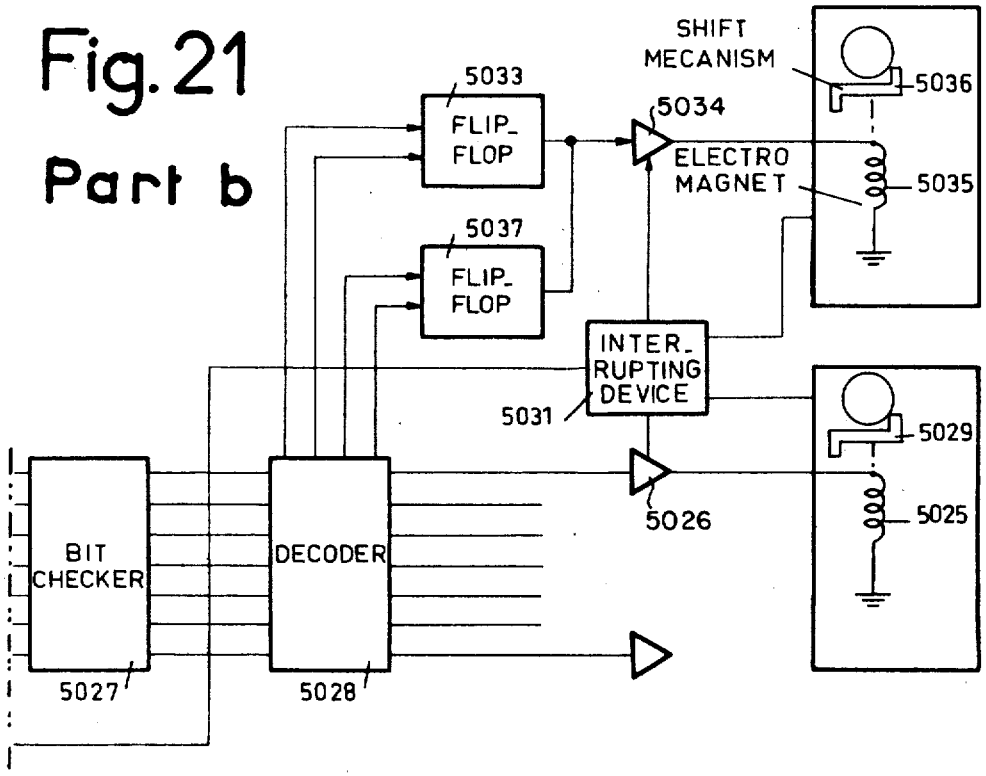

The device includes eight shift registers, 5010 to 5017 (FIG. 21). Each one corresponds to one of the coding matrices and it is for this reason that they are also indexed: one by zero and the others by the roman numerals I to VII. The outputs of each matrix are connected to the inputs of the corresponding register. It will be seen moreover that the eight registers are linked so that their inputs are in parallel and their outputs in series and that they constitutes provisional memories.

As soon as a matrix has coded an information, this one is memorized in the corresponding register. It remains, therefore, stored there, even when the corresponding key has risen again and the contact is broken, so long as all the depressed keys have not risen again. Such shift registers are built by Texas Instruments Corporation and sold under the trademark S N 74 166.

Main Memory

The main memory 5021, in which the pieces of information are stored after leaving the shift registers 5010 to 5017 until each piece is sent to the printing mechanism 5029, can be of one of the usual types used in data processing and which are found in the form of integrated circuits which are mass produced. For example that manufactured and sold by Texas Instruments Corporation and sold under the trademark S N 7489. Each information is stored in a division of the memory. Each division includes at least as many binary elements as there are "bits" in the code. The binary elements can be made up of magnetic flip-flops (for example: ferritetores) or of electronic flip-flops (including, for example, semi conductor components). This main memory, instead of being of static type, as in the described embodiment, can be a dynamic one. Such memory are built by Fairchild Corporation.

The memory must be constructed to be able to contain the number of data, therefore of binary numbers, corresponding to the maximum accumulated delay of the printing in relation to the striking on the keyboard, the rare cases being neglected. This maximum is the one which can be attained during the successive use of several keys corresponding each to a large combination, by a rapid typist. This is the case, for example, when this typist strikes in a text: "that man was in Canada for you". . . ; this on a keyboard such as the one shown in FIG. 8 or 16.

This maximum is as much great as the printing mechanism is less rapid. With the keyboard shown in FIG. 20, and a printing mechanism with type bars, the main memory must be able to retain approximately 30 data, therefore it must include approximately 30 storage divisions. If the printing mechanism utilize a printing sphere and is therefore more rapid, the necessary number of divisions is slightly lower.

The main memory is equipped with an addressing device 5018 the function, the characteristics and the working of which are described below.

Transfer from the shift registers into the main memory

It is known that when a pulse is applied to the conductor which controls the shift in a shift register, the content of each element in this register is transferred to the element next to it. If a number of pulses equal to the number of elements in the register is applied, the bits contained in the register will appear successively at one of the extremities chosen as an output.

Now the shift registers 5010 to 5017 (FIG. 21) are connected in series, the output of each one being linked to the input of the next. To transfer the data contained in the assembly of these eight shift registers to the main memory, the monitor 5022 applies a series of eight trains of pulses to the conductor which controls the shifting of register 5010–5017, the number of pulses of each train being equal to the number of bits contained in each register. The result is that at the output of the register 5010 (zero) there appears successively and in the following order: the contents of the zero register, then that of register I, then II and so on up to the arrival of that of register VII.

The clock

The necessary pulses are supplied to the monitor by a clock pulse generator 5023 which is linked to the monitor. Such a device is usual in data processing. It is, for example, that in quartz manufactured by Quartz Corporation. It is also the pulses emitted by this clock which the monitor uses to control the other transfers.

Checker for the bits before memorising (recording) and cramming

When the state of a coding matrix has been modified by a striking, the coded information which it generates and transmits to the corresponding shift register, includes one or several bits 1 (one). This information is then called significant. When no striking corresponding to a given matrix has been effected, the corresponding register contains bits 0 (zero) only and the information which leaves the register does not signify anything. It is therefore called "nul." Amongst the eight data sent in series by the shift registers to the checker, some nul data are generally included. Only the significant data will act on the printing mechanism. In order not to overcrowd the main memory uselessly, a bit checker 5024 is installed in the transfer line to the main memory. It is made up in such a way as to prevent the monitor 5022 from transferring the nul data to this memory. There is therefore a cramming that is to say a juxtapositioning of the significant data in the main memory. Moreover the bit checker only allows the transfer of information which fulfills certain conditions of validity. The establishing of this last checking is optional and can be more or less extended: checking of parity or imparity, checking the number of bits if the code is of constant weight. Such bit checkers are well-known. For example, that one manufactured by Texas Instruments and sold under the trademark S N 7485 may be utilized.

Device for interrupting the transfer to the main memory, equipped with a delaying element The keyboard 4021 is linked to the monitor 5022 through an imput interrupt device 5030 which, moreover, is equipped with a means for creating an adjustable delay of approximately six hundredths of a second. Such a device is well-known. The depression of any of the keys sends a signal to the monitor passing through this device 5030. But, when several keys are struck at the same time, all the contacts are not established with perfect simultaneity. The monitor is designed in such a way that it releases the transfer of the contents of the shift registers 5010 to 5017, to the main memory 5021, when it has received the signal which arrives first, but so that it does not react to the signals which arrive at the first one. Thus, only one transfer can be obtained for each group of strikes. Moreover, the delay created by the device 5030 is adjusted in such a way that the emptying of the registers is not engaged by the first of these, until the most delayed information arrives in its corresponding register.

The temporary memorising ensured by the shift registers 5010 to 5017 is necessary for the cases where, at the moment of transfer of data to the main memory, certain of the contacts established by the keys have already been broken by the release and rise of the keys.

Announcement of striking to the monitor

So that the depression of each key provokes the sending of a signal to the monitor, the following method is used.

FIG. 13 shows that many keys require one signal contact only whereas each of the switches creates at least two. Instead of linking the output of the second, all these outputs which are not used are crossed by one line which finishes at the delay device 5030. A shunt, fitted with a diode, is also established in the automatic spacing line (Sp. Auto.) but this before the neutralising switch (Neut.). This shunt rejoins the preceding line.

In addition, such a shunt, fitted with a diode, is also established on each of the exit lines for the consonants of group I whih are coupled on certain keys with a letter of group II. In the keyboard shown in FIG. 20, these are F, P, M, C, N, D, T, R, L, S, V, Q, therefore twelve lines. Each of these shunts rejoins the preceding line. These lines are not shown in the drawing. Other well-known means may also be utilized.

Decoding Matrix or decoder

The data having been coded it may be necessary that each one be decoded in order to send a pulse to the corresponding electromagnet controlling the printing mechanism. It is for this reason that a decoding matrix 5028 (FIG. 21) is included in the storage unit shown in FIG. 21.

Such devices are well-known in data processing and will therefore not be described in detail. It is the reverse of a coding matrix. The bits which compose the information being received on different inputs, this produces a voltage at only one output which is that connected to the electromagnet to be excited. The coding matrices is therefore a combination of NAND gates and NOR gates. As in the whole device described a weak current has been used, it is therefore necessary to install a power amplifier 5026 on each of the output lines of the decoding matrix, in order to actuate the corresponding electromagnet. If the general chosen code for building the coding matrices correspond to the general code corresponding to the printing mechanism, a decoding matrix is useless. That is the case in the embodiment shown in FIG. 21 in which the coding matrices are built with the general code IBM if the printing mechanism is that of an IBM typewriter of the type 73, or of the type sold under the trade name "connected electric typewriter without keyboard."

Number of electromagnets to be controlled

If the printing mechanism uses type bars, there are the same number of electromagnets as type bars, plus one for the spacing and one for each subsidiary operation. If the printing mechanism is of a type using a printing sphere, it is well-known that, to obtain the printing of a given character, the position of the sphere is obtained by means of a set of swingle tree, that is, differential levers, this enabling the use of only six electromagnets plus one to obtain the changing of the case position, giving seven, plus one for spacing and one for each subsidiary functions. The coding matrix is therefore more simple. The same applies where the mechanism is of a type using a printing cylinder.

Bit checker at the exit from the main memory

The transfer tracks between the main memory 5021 and the decoding matrix 5028 pass through a bit checker 5027 similar to the checker 5024 and which only lets through the effective data which exist in the code. Therefore if a memory division addressed by the addressing device is empty, this checkes does not transmit anything. It stops parasite data in the same way. Like the checker 5024, it can be designed in such a way as to exercise a checking which is more or less extended.

Addressing device and its auxiliary register for address storage

The main memory 5021 is fitted with an addressing device 5018 made up of a register closed in a loop. This device has the following two functions:

Firstly, for each input in the memory (writing), it directs each information coming from the entry bit checker 5024, towards the memory division which follows that in which the last writing operation was effected.

Secondly, for each output (reading) it connects the division whose contents must be read, for sending to the exit checker 5027. This division is the one which follows the division in which the last operation, either writing or reading, has been effected. The monitor 5022 is linked to this addressing device of which one output is linked to the main memory.

The addressing device is made up in such a way as to retain the address of the division in which it has effected a reading or a writing operation. This address is then, according to the case, either increased by one unit through a pulse or replaced by the address of the last writing. To enable this replacement, the addressing device is fitted with an auxiliary address storage register 5032. This register receives from the addressing device, and retains, the address of the last writing operation, after each emptying operation of the series of the shift registers 5010 to 5017. It returns this address to the addressing device when a new series of writing operations is to be effected. These transfers of address are controlled by the monitor 5022. It is for this reason that the monitor is connected to an input of an auxiliary address memory 5032. This latter is linked to the addressing device 5018 by one of its inputs and by an output. Such addressing devices are well-known. They are utilized in each computer. Therefore, their structure will not be described nor shown in the drawing. The auxiliary address memory 5032 (FIG. 21) may be of the type manufactured by Texas Instruments Corporation and sold under the trademark S N 7475.

Working for writing in the main memory

The monitor 5022, controls the transfer of the content of the auxiliary address memory 5032 (that is of the address of the last writing) to the addressing device 5018. This transfer does not destroy this address in the auxiliary address memory 5032. The monitor then increases this address by one unit in the addressing device and then engages the emptying of the shift registers 5010 to 5017. The last valid information leaving the series of shift registers is transferred to the division bearing this address, by the checker 5024. After each memorising of one of these data the monitor increased the address by one unit in the addressing device, that which directs the following significant and valid information towards the following division. The number of data found in the assembly of the eight shift registers varies from one to eight according to the number of elements which have been struck simultaneously. They will therefore occupy as many consecutive divisions and will thus be situated immediately following the data which result from the previous striking, if these data have not yet been read. At the end of these series of writing operations, the monitor transfers the address of the last writing operation from the addressing device to the auxiliary address memory 5032 so that this latter can retain it for the following writing operation after one or several reading operations.

Working for the reading in the main memory

As soon as the series of writings is finished, if the printing mechanism 5029 is available, or as soon as it is, the monitor 5022 controls the transfer of the contents of the auxiliary address memory 5032 (that is, of the address of the last writing) to the addressing device 5018. The transfer does not destroy the address in the auxiliary address memory 5032. The monitor 5022 then increases the address by one unit in the addressing device 5018, that which connects the following division to the bits checker 5027. The monitor 5022 then engages the reading of the content of this division, that is, its sending towards the exit checker 5027. If this division were empty, which is generally the case, the checker 5027 engages, through the intermediary of the monitor, a new increase of one unit of the address in the addressing device, then a new reading operation and so on, until all the empty divisions have been explored and the reading operation has been effected in a division containing a valid information. This information is the oldest which is still in the main memory.

The checker 5027 transmits this information to the printing mechanism to control the realization of the corresponding operation. The monitor 5022 is then advised that the printing mechanism is not available, by an interrupt device 5031 which will be described below. The monitor is thus in a position to engage a new emptying of the registers 5010 to 5017, if however the interrupt device 5030 requests this operation, that is, if a new striking operation has already been realised.

If no new striking operation has been realised, the monitor awaits either a strike, in which case it empties the registers 5010 to 5017, or the availability of the printing mechanism, in which case it engages a new reading operation.

As the main memory is made up of a loop, the writing and reading operations are realised by travelling along the loop in the same direction. Furthermore, as soon as a reading operation has been carried out, the printing mechanism is not available, thus preventing, momentarily, a new reading operation. A series of writing operations can therefore be carried out before the following reading operation, but only if a new striking has been effected. To obtain this, the addressing jumps from the division which has just been read, first of all to the division in which the last writing operation was effected (this by the transfer of the address) then to the following division which is empty (this by the increase of one unit in this address) in order to write in it the first data which leave the registers 5010 to 5017.

Device for interrupting the reading during the realization of each operation

An interrupt device 5031 is situated in a line which links the printing mechanism 5029 to the monitor 5022. This device is similar to the interrupt device 5030, but does not produce a delay.

Each sending of information to the printing mechanism, by the checker 5027, acts on this device 5031 which, through the intermediary of the monitor, prevents all further reading operation until the printing mechanism 5029 has returned to its rest position. The monitor is thus placed in the "waiting" state, either for the availability of the printing mechanism, or for a new striking operation.

Possibility of striking a character in one group of a rank which is higher than that which corresponds to its place in the printing of characters which are struck simultaneously In the combination "Cs Me Ia", as it has just been described, only the significant data control the printing mechanism. It results that only the information which corresponds to a space, according to the code, produces an empty space. It follows that if, in a group of a given rank no character is struck, whereas one in a group of a higher rank is struck, no spacing is produced. This is a difference in relation to the combination in which the printing mechanism is syllabic. Thus, for example, if a character of group II and a character of group IV are struck simultaneously, without any striking in groups I or III, there is no empty space produced in front of the character of group II nor between the characters of groups II and IV. One can therefore strike a character in a group of a rank higher than the one which corresponds to the place which it must occupy in the printing, on condition that the striking of the other characters, which eventually follow it, and which are struck at the same time, are "transposed" to the same amount.

First consequence

If an initial letter which is a vowel, not existing in group I, is struck in group II, and no information is sent to the matrix I (FIG. 21) no excess space is produced in front of this character. The operator therefore strikes the space which must precede the initial at the same time as the end of the preceding word, as in the general case.

Second consequence

Certain terminal combination keys can be used to print monosyllabic words, this without having to strike the back space key. For example, the keys "en" and "in" (FIG. 20) can be used alone, although their first letter is in group III.

Third consequence

When the same letter exists in several groups and this letter is the last of those which one wishes to strike simultaneously it can always be struck in a group in a rank higher than its own rank amongst the characters printed, if this is more advantageous for the fingering. Thus for example, on the keyboard shown in FIG. 20, to strike "vit" in "vitriol" (vit/rio/l), instead of striking $t_{III}$,$t_{IV}$ could be struck, thus enabling use of the right hand only.

Fourth consequence

In the keyboard shown in FIG. 20, the consonant keys of group III can be suppressed ($N_{III}$,$S_{III}$,$R_{III}$,$T_{III}$) and replaced by the consonant keys of group IV ($N_{IV}$,-$S_{IV}$,$R_{IV}$,$T_{IV}$) which, in FIG. 20, are to the right and in front of the right hand space key. The same key is thus used for each of these consonants, whether it is to be printed in the third or the fourth printing point. This simplifies the fingering and liberates some keys to which may thus be assigned other letters, for example, the letter $D_{IV}$, foreseen below and supplementary functions.

Possibility of creating new character keys without modifying the printing mechanism When a syllabic keyboard controls a printing mechanism which is also syllabic as shown in FIG. 14, the number of characters attributed to the keys of the assembly of group I to IV is limited by the number of characters which are included in the printing mechanism. On the contrary, when the syllabic keyboard controls a non-syllabic printing mechanism, if a given character exists in this mechanism, it is possible, on the keyboard, to assign this character to several keys in any group, without altering the printing mechanism. However, one is limited by the necessary of not extending the keyboard more than is necessary and not complicating the fingering too much. A limit is therefore imposed to the cases justified by the frequency of use in the language to which the keyboard is adapted. But it is therefore sufficient to code the datum which corresponds to this character through the matrix or matrices which correspond to the groups selected.

For example, in the keyboard shown in FIG. 20, composed for the French language, a key $D_{IV}$ can be created, which will be used to print $D_{IV}$ and $D_{III}$. This key $D_{IV}$ will therefore serve, for example, to strike "red" in "redresser" (red/res/ser) "ad" in "adresse" (ad/res/se). It will facilitate typing of an English text, where almost all the past participles end in "ed" and where $D_{IV}$ is frequently used (read, b/read, end). This key, $D_{IV}$, will also facilitate the typing of the German language on the same keyboard (und,land,sind). The keyboard would therefore become more universal.

Descent in 2nd case position (capitals) and return to first case position (small letters)

The non-syllabic printing mechanism used, being of conventional type, has two case positions only and its shift mechanism is therefore also conventional.

In all cases, the shift mechanism is fitted with electromagnets through which are produced the engagements desired on the driving element to obtain each change of case position. This method of engagement is the one already used when a conventional typewriter is controlled from a distance or by a storage device. Two methods can be used:

1st method

To place the mechanism in 2nd case position a pulse is sent to an electromagnet whose mobile armature acts on a mechanical locking lever, as if this lever were displaced directly by the key. To return the mechanism to the first case position a pulse is sent to another electromagnet whose mobile armature unlocks the lever.

2nd method

To place the mechanism in second case position, an electromagnet is put into circuit; its mobile armature acts on a lever which has no locking device. To retain second case position, the electromagnet is left under current. To return to first case position the circuit to the electromagnet is cut off.

In the embodiment which is described here the second method is used.

The printing mechanism may include type bars or a printing sphere, or be of any other type. Regardless of the type of the printing mechanism, the changing of the case position is necessary in the following two cases:

1ST CASE

All characters are to be printed in capital letters. For example, a title or a proper noun The operator strikes the key "Bolt 2nd") at the same time as the first group of characters which he wishes to print in second case position (capitals), with or without spacing. The contact made by the key Bolt 2nd generates an information, corresponding to the placing in second position and to its retention, in the zero matrix. The striking of the character keys and spacing generates the same data as if it were for printing in first case position (small letters) and this in the same matrices. According to the normal process described, these data are transferred into the main memory 5021 (FIG. 21) in the order of the coding matrices. They will later be sent to the decoding matrix 5028 in the same order. The information Bolt 2nd therefore arrives there first. It produces a voltage at one of the outputs of this matrix which is connected to an input A of an electronic flip-flop 5033. This flip-flop is of the type which retains the voltage at its output even after the signal at its input A has disappeared. This voltage, after amplification by power amplifier 5034, excites the electromagnet 5035. This magnet produces engagement of the shift mechanism 5036 for the placing into second case position of the printing mechanism 5029. This latter remains in second case position as the flip-flop 5033 retains the voltage. The mechanism 5036 is equipped with means so that, during its displacement, it acts on the interrupt device 5031 to prevent any printing during this displacement. This action is analogous to the one which the printing mechanism 5029 applies to the interrupt device 5031 so that no new character be decoded until the printing mechanism is available. All the characters struck after striking of the key Bolt 2nd, and this until the return to first case position is controlled, are printed in case position 2.

After striking the last of the characters which he desires to print in second case position, the operator strikes the key "Pos.1" at the same time as the last characters, with or without spacing, which he desires to print in 2nd case position. The key "Pos.1" is the one which, in the keyboard shown in FIG. 20 and in those described earlier was designated "Tout 2e" (All 2nd) and whose depression had already the effect of returning the mechanism into first case position. The contact made by this key generates the information corresponding to return to first case position, in the matrix VII. This information is transmitted to the main memory 5021 at the same time as that corresponding to the characters and to the spacing where required; this by the normal process and in the order of the coding matrices. The data corresponding to the characters and to the spacing are sent successively to the printing mechanism 5029 as in the normal case. The information "Pos.1," having been generated in the matrix VII, is only read afterwards. It is transmitted to the coding matrix 5028 which sends a pulse to the input B of the flip-flop 5033. This is the entry for return to zero of the flip-flop. The result is the elimination of the voltage at the output of the flip-flop and therefore in the power amplifier 5034 and in the electromagnet 5035 as well. This latter, being no longer excited, enables the engaging of the shift mechanism 5036 on the driving element, to return the printing mechanism 5029 into first position. During this motion of the mechanism 5036, the printing of any character is prevented by the interrupt device 5031 in the same way as during its motion of placing in second position. The characters which may have been struck by the operator after striking the key "Pos.1" will be therefore printed in first position (small letters).

2ND CASE

Only the initial letter is to be printed in second case position (capitals), the letters which follow and which are struck at the same time are to be printed in small letters In the machines using a syllabic printing mechanism, the distinction has been made where this initial letter is of group I (Key, 2eI) and where it is of group II (Key, 2e II). In the present combination where the printing mechanism is not syllabic and where the buffer storage device only controls a space if the information corresponding to a space is generated, this distinction is not necessary. The two keys "2eI" and "2eII" ("2nd I", "2nd II") (FIG. 20) are therefore replaced by one key "Ini.2" only. The striking of this key ensures the printing in 2nd case position of the initial letter only, regardless of the group to which this initial letter belonged, that is, regardless of the coding matrices I to VI to which it is affected.

To thus obtain only the initial letter in case position 2, the operator strikes the key "Ini.2" at the same time as he strikes the single character or the characters, with or without spacing, which he wishes to strike simultaneously. The information "Initial in capitals" is generated in the zero matrix. The data corresponding to the characters and to the eventual spacing are generated in the same matrices as when key Ini.2 is not struck. All these data are transferred, in the order of the matrices and following the normal process, into the main memory 5021. They are extracted from this memory in the same order and sent to the decoding matrix 5028. The information corresponding to the placing in case position 2 for the initial alone, produces a voltage at one of the exits of the decoding matrix 5028 which is connected to an input C of an electronic flip-flop 5037. This flip-flop is of the same type as 5033. It therefore retains the voltage at its output even after the signal at the input C has disappeared. This voltage, after emplifying by the power amplifier 5034, excites the electromagnet 5035, which, as in the preceding case, produces the engagement of the shift mechanism 5036, to place the printing mechanism 5029 in case position 2. This mechanism remains in case position 2. Up to now the process if therefore the same as in the first case, with the difference that the information Ini.2 has actuated the flip-flop 5037 in place of the flip-flop 5033. The printing of the first of the characters struck after depressing the key Ini.2 will therefore be effected in case position 2 (capitals). But the input D for return to zero of the flip-flop 5037, is connected to the printing mechanism 5029 in the same way as the interruption device 5031. It follows that the printing of this first character has the effect to send a pulse to the input D of the flip-flop 5037, thus eliminating the voltage at the output of this flip-flop as well as in the power amplifier 5034 and to the electromagnet 5035. The latter being no longer excited, it enables the engagement of the shift mechanism 5036 on the driving element, in order to return the printing mechanism 5029 into case position 1. During this motion, any reading, and as a result any printing of a character, is prevented by the interrupt device 5031, as during the preceding motions.

The characters struck on the keyboard at the same time as the key Ini.2 and as the initial letter, but whose printing is realised afterwards, are printed in case position 1 (small letters). The shift keys can therefore be struck at the same time as characters thus increasing the striking speed. With regards the key Ini.2, the increase in speed is even more important when typing in German, where the initial letter of all the substantives must be a capital letter.

This structure of the device also enables the creating of a programme key for certain characters, which, in the usual printing mechanism, are situated in case position 2 and whose use is nonetheless frequent. The depression of each one of these keys then simultaneously generates the information which corresponds to the placing in case position 2 of the first character alone (Ini.2) in the zero matrix and generates the information which corresponds to the character in question in the matrix which normally corresponds to this character. If the sign "full stop" (.) exists only in case position 2, one can thus create a special "full stop" (.) key which is equipped with an automatic space. In such an example the key engages a programme of three operations or even four, as the return to position 1 is automatic.

Striking of subsidiary operations other than shifting of case position

It has been explained that the information corresponding to "Back space" and that corresponding to "Tabulation" are generated in the zero matrix. It results that each of these keys can be struck at the same time as the characters, with or without spacing, which must follow each of these operations. The explanation of this possibility is the same as the one given about the key "Tout 2e" (All 2nd) and will therefore not be repeated. Interruption of the reading in the main memory during each of these operations is realised in the same way as during the changing of case position and during the print of each character. However, in FIG. 22, the corresponding links with the interrupt device 5031 are not shown.

Striking the carriage-return key

It has been explained that the information corresponding to the carriage return is generated in the VII matrix. It results that the corresponding key can be struck at the same time as the last characters on the line. For these latter, one can use the same keys as are normally used, including the keys which are provided with an automatic spacing device, although the space in superfluous in this case.

An interruption of the reading during the carriage return is effected in the same way as in the preceding cases.

Key for actuating a programme

The existence of a buffer storage unit including coding matrices enables the creation of one or several keys, each one of which engages a programme. But for this, the programme operations must be coded in the matrices situated in the same order as the programme. The number of operations of each programme can reach that of the existing matrices, for example, eight, if the device comprises the matrices zero to VII (FIG. 21).

As an example, a key for "change of paragraph" is foreseen which controls the following programme (this programme presumes that the full stop (.) only exists in case position 2):

| | | |
|---|---|---|
| Initial in case position 2 | In zero matrix | Already wired. |
| Full stop. | In matrix I | Already wired. |
| Carriage return. | In matrix II | To be wired, as, for the general case, it is in matrix VII. |
| 2nd carriage return, to obtain double lead (for paragraph) | In matrix III | To be wired. |
| Tabulation (to obtain the indent to first tabulation stop) | In matrix IV | To be wired as it is in the zero matrix. |
| Initial letter in case 2. | In matrix V | To be wired as it is in the zero matrix. |

After striking the last word in the paragraph, the operator does not strike the full stop. He depresses the key "change of paragraph" (not shown) then the first group of simultaneous strikings of the new paragraph.

The electric conductor which controls the second carriage return passes through a switch which enables the operator to eliminate this programme operation momentarily. When he wishes to type a text with double lead, this elimination is necessary so that the double lead is not again doubled after each paragraph.

If the printing mechanism includes a full stop (.) in case 1, the programme corresponding to the key change of paragraph is reduced to five operations, the first one being suppressed.

It has been seen that some keys are rendered available by the suppression of the consonants of group III, thus enabling the creation of a key "Full stop and space", of the key change of paragraph and of certain other additional keys, without increasing the overall number of keys on the keyboard shown in FIG. 20.

The electronic buffer storage unit which has been described, forms the required link between the syllabic keyboard and the non-syllabic printing mechanism, and therefore forms the combination Cs Me Ia. However, this description is brief and schematic. In reality this device includes certain auxiliary and conventional components which have not been described, but of which the necessity is evident for an electronics engineer specialised in data processing.

All the elements mentioned, or described briefly, being usual their internal structure has not been given in dertail. Components which are mass produced for other uses and, in particular, logical integrated circuits, are used as much as possible.

What we claim and desire to secure by Letters Patent is:

1. A keyboard-controlled device including a syllabic keyboard certain keys of which can be simultaneously depressed, certain of said keys being each provided with means for simultaneously controlling several characters belonging to different character groups each of said groups corresponding to a distinct printing point, two other of said keys at least being each provided with means for controlling a spacing and other of said keys being each provided with means for controlling a subsidiary function, all said keys being each provided with an electric switch, certain keys (FIGS. 7, 8, 16, 20)

being arranged in rows and columns, certain of said keys which each control simultaneously a character of a first character group and a character of a second character group being arranged in a rectangular matrix; in certain rows of the keys, a central key controlling only the character of the second character group which is also controlled by other keys of said rectangular matrix in the same key row (for example the central key which controls "*e*" of the character group II in FIG. 8), in several key rows of the rectangular matrix, two keys adjacent to the central key controlling only a character of a third character group (for example the two keys each controlling "*a*" of character group III in FIG. 8), said character being the same for the two keys; the keyboard comprising two spacing keys the width of which is about that of two key columns of the rectangular matrix and the length of which is at least equal to that of three key rows of said rectangular matrix; said spacing keys forming a left and right space key and being disposed in front of said rectangular matrix and being spaced laterally from one another on opposite sides of the keyboard center, and said keyboard comprising three sets of thumb-operated keys which are elongated in the direction of the key rows of said rectangular matrix, the width of said thumb-operated keys being approximatively twice that of a matrix key column, each of said sets of thumb-operated keys comprising three keys situated respectively in three rows, one set of three said thumb-operated keys being situated between the two space keys, a second set to the left of the left space key, and the third set at the right of the right space key, all said thumb-operated keys adjacent to the space keys being in the same plane as said space keys, so that a thumb of an operator can depress each of these thumb-operated keys, either alone or at the same time as an adjacent space key; the device including several coding matrices to which the keyboard is connected, so that said keyboard transmits simultaneously to said coding matrices pulses corresponding to characters, to spacings, and to subsidiary functions, which are assigned to the simultaneously depressed keys; the device including a buffer storage unit to which the coding matrices are connected, so that said coding matrices send to said buffer storage unit codes corresponding to said characters, spacings, and subsidiary functions respectively.

2. A device as claimed in claim 1 in which the buffer storage unit comprises a main memory, the device further comprising a non-syllabic printing mechanism, means for reading successively said codes one at a time in said main memory, and a decoder for supplying successively, to the non-syllabic printing mechanism, data corresponding to each of said characters, spacings and subsidiary functions respectively.

3. A device as claimed in claim 1, comprising at least one key provided with circuit means (FIG. 23) for entering simultaneously in said coding matrices pulses corresponding in said coding matrices to the codes of several characters, spacings, and subsidiary functions, which constitute a programme and which are subsequently carried out automatically and separately when said key has been depressed, such as a programme comprising the full-stop and all the subsidiary functions to pass from the last letter of a paragraph to the first letter of the next paragraph.

4. A device as claimed in claim 1, the buffer storage unit comprising a tape (FIG. 18) which constitutes a storage medium and means (FIGS. 24 and 18) for recording simultaneously in successive transversal lines of said tape the codes corresponding to the characters, to the spacings, and to subsidiary functions, assigned to the simultaneously depressed keys, and means for advancing the tape by jumps of different lengths (FIGS. 2 to 6, 10 to 12 and 18, 19), the length of each jump corresponding to the number of transversal lines occupied by said codes.

5. A keyboard-controlled device including a syllabic keyboard certain keys of which can be simultaneously depressed, certain of said keys being each provided with means for simultaneously controlling several characters belonging to different character groups each of said groups corresponding to a distinct printing point, one other of said keys at least being provided with means for controlling a spacing and other of said keys being each provided with means for controlling a subsidiary function, all said keys being each provided with an electronic switch, the device including several coding matrices to which the keyboard is connected, so that said keyboard transmits simultaneously to said matrices pulses corresponding to characters, to spacings, and to subsidiary functions, which are assigned to the simultaneously depressed keys; the device including a buffer storage unit to which the coding matrices are connected, so that said coding matrices send to said buffer storage unit codes corresponding to said characters, spacings, and subsidiary functions respectively the buffer storage unit comprising a tape (FIG. 18) which constitutes a storage medium and means (FIGS. 24 and 18) for recording simultaneously in successive transversal lines of said tape the codes corresponding to the characters, to the spacing and to subsidiary functions, assigned to the simultaneously depressed keys, and means for advancing the tape by jumps (FIGS. 2 to 6, 10 to 12 and 18, 19), the length of each jump corresponding to the number of transversal lines occupied by said codes; the different lengths of the jump-wise advance of the tape being obtained (FIGS. 18 and 19) by means comprising an escapement wheel having movable cogs which are movable on said wheel, from a stop position to an escapement position, and in which the escapement obtained is proportional to the number of the cogs displaced from a stop position to an escapement position (FIGS. 2-6 and 10-12), the wheel being optionally combined with an escapement anchor (FIGS. 5 and 6) in order to augment the total escapement by a single interval.

6. A device as claimed in claim 5, in which the tape is a magnetic tape (FIG. 18),

7. A keyboard-controlled device including a syllabic keyboard certain keys of which can be simultaneously depressed, certain of said keys being each provided with means for simultaneously controlling several characters belonging to different character groups each of said groups corresponding to a distinct printing point, one other of said keys at least being provided with means for controlling a spacing and other of said keys being each provided with means for controlling a subsidiary function, all said keys being each provided with an electric switch, the device including several coding matrices to which the keyboard is connected, so that said keyboard transmits simultaneously to said matrices pulses corresponding to characters, to spacings, and to subsidiary functions, which are assigned to the simultaneously depressed keys; the device including a buffer storage unit to which the coding matrices are connected, so that said coding matrices send to said buffer storage unit codes corresponding to said characters, spacings, and subsidiary functions respectively; said buffer storage unit comprising a tape (FIG. 18) which constitutes a storage medium and means (FIGS. 24 and 18) for recording simultaneously in successive transversal lines of said tape the codes corresponding to the characters, to the spacing, and to subsidiary functions, assigned to the simultaneously depressed keys, and means for advancing the tape by jumps (FIGS. 2 to 6, 10 to 12 and 18, 19), the length of each jump corresponding to the number of transversal lines occupied by said codes; the device further comprising a non-syllabic printing mechanism, and the tape which constitutes the storage medium being an endless magnetic tape (FIG. 18) of which a free portion constitutes a buffer memory the length of which varies according to the number of the characters, spacings and subsidiary operations already typed and not yet decoded, this portion of the tape forming a free loop (4002) between a magnetic recording head controlled by the keyboard and a magnetic reading head which controls the operation of the printing mechanism, the two heads being arranged in sequence.

8. A device as claimed in claim 5, in which the tape is a punched tape which after punching may be kept for ulterior uses, and the device comprising: a set of perforators covering at least as many transversal successive lines on the tape as there are character groups having distinct printing points, plus a transversal line corresponding to the spacing, the perforators punching simultaneously, in different transversal lines on the tape, codes corresponding to the characters, to the spacing, and to the subsidiary functions assigned to the simultaneously depressed keys; and a device (FIGS. 2–6, 18 and 19) for advancing the tape by jumps, the length of each jump corresponding to the number of transversal lines in which codes have been simultaneously recorded.

9. A keyboard-controlled device including a syllabic keyboard certain keys of which can be simultaneously depressed, certain of said keys being each provided with means for simultaneously controlling several characters belonging to different character groups each said groups corresponding to a distinct printing point, one other of said keys at least being provided with means for controlling a spacing and other of said keys being each provided with means for controlling a subsidiary function, all said keys being each provided with an electric switch, the device including several coding matrices to which the keyboard is connected, so that said keyboard transmits simultaneously to said matrices pulses corresponding to characters, to spacings, and to subsidiary functions, which are assigned to the simultaneously depressed keys; the device including a buffer storage unit to which the coding matrices are connected; so that said coding matrices send to said buffer storage unit codes corresponding to said characters, spacings, and subsidiary functions respectively; the buffer storage unit comprising a tape (FIG. 18) which constitutes a storage medium and means (FIGS. 24 and 18) for recording simultaneously said codes in successive transversal lines of said tape respectively, and means for advancing the tape by jumps (FIGS. 2 to 6, 10 to 12 and 18, 19), the length of each jump corresponding to the number of transversal lines occupied by said codes; the tape being a punched tape which after punching may be kept for ulterior uses, and the device comprising: a set of perforators covering at least as many transversal successive lines on the tape as there are character groups having distinct printing points plus a transversal line corresponding to the spacing, the perforators punching simultaneously said codes in different transversal lines on the tape, and a device (FIGS. 2–6, 18 and 19) for advancing the tape by jumps, the length of each jump corresponding to the number of transversal lines in which said codes have been simultaneously recorded; the keyboard-controlled device further comprising a non-syllabic printing mechanism, a reader for successively reading the codes in successive transversal lines on the tape, the length of tape between the set of perforators and the reader varying according to the number of codes already recorded and not yet decoded, and forming a free loop constituting a buffer memory, a device for advancing the tape line by line under the reader, and a decoder connected between the reader and the non-syllabic printing mechanism.

10. A keyboard-controlled device including a syllabic keyboard certain keys of which can be simultaneously depressed, certain of said keys being each provided with means for simultaneously controlling several characters belonging to different character groups each of said groups corresponding to a distinct printing point, one other of said keys at least being provided with means for controlling a spacing and other of said keys being each provided with means for controlling a subsidiary function, all said keys being each provided with an electric switch, the device including several coding matrices to which the keyboard is connected, so that said keyboard transmits simultaneously to said matrices pulses corresponding to characters, to spacings, and to subsidiary functions, which are assigned to the simultaneously depressed keys; the device including a buffer storage unit to which the coding matrices are connected; so that said coding matrices send to said buffer storage unit codes corresponding to said characters, spacings and subsidiary functions respectively; the number of coding matrices (5000 to 5007) (FIG. 21) being at least equal to the number of characters, spacing, and subsidiary functions, assigned to the keys which can be depressed simultaneously, the buffer storage unit comprising moreover: a main memory (5021) and at least as many shifting registers (5010 to 5017) (FIG. 21) as there are coding matrices, said shifting registers being connected with one another in a series, each of the coding matrices being connected to one of the shifting registers which serve to memorize the codes until they are sent to the main memory to which the series of shifting registers is connected, so that the inputs of the shifting registers are in parallel and their outputs in series, a device (5030) for interrupting transfer to the main memory, an addressing device (5018) for controlling writing into and reading out of the main memory, a decoder (5028), a reading interrupt device (5031) controlled by a system to which the exit of the decoder is connected, a clock pulse generator (5023), and a monitor (5022) for monitoring the operations of the device, so that the buffer storage unit receives simultaneously, from the keyboard (4021), several pulses corresponding to the simultaneously depressed keys, and sends successively data corresponding to the separate characters, to the spacing and to each subsidiary function, to a system connected at the output of the decoder at a cadence accepted by said system.

11. A device as claimed in claim 10, in which certain characters assigned to given keys are each coded in coding matrices the ranks of which are higher than the ranks of character groups to which these characters correspond respectively in most cases; which enables the operator to strike, at the same time as these characters, a varying number of other characters coded in matrices of lower rank, for example: $E_{III}$ with $S_{IV}$ (FIG. 8) permit to strike YES or CHES by a single operation.

12. A device as claimed in claim 10, in which certain matrix keys are arranged and combined in a rectangular matrix, certain of said matrix keys each controlling simultaneously a first character assigned to several keys in the same column of keys and a second character assigned to several keys in the same row of keys to which the considered matrix key belongs, the first character assigned to several keys of the column being coded in a coding matrix of a given rank and the second character assigned to several keys of the row being coded in a coding matrix the rank of which is higher than the rank which immediately follows the given rank, and the keyboard comprising other keys which control characters each coded in a matrix the rank of which is intermediate between the ranks of the matrices in which are coded the first and the second characters respectively; which enables an operator to simultaneously strike one of these other keys, and one of these matrix keys, so that the device controls successively: firstly the first character controlled by the struck matrix key, next the character controlled by the other struck key, and then the second character controlled by the struck matrix key; for example: if the consonant P assigned to the matrix keys PI, PE, PO, PA (FIG. 8 or FIG. 20, column 1) is coded in a coding matrix of rank I and if the vowels I, E, O, A assigned respectively to the same matrix keys are coded in a coding matrix of rank II, and if the letter H (column 2 line 1) is coded in a coding matrix or rank $I_A$ which is intermediate between I and II, it is possible to strike simultaneously the two keys:

PI and H to obtain "phi" in "philosopher,"
or PE and H to obtain "phe" in "phenol,"
or PO and H to obtain "pho" in "photograph,"
or PA and H to obtain "pha" in "pharmacy."

13. A device as claimed in claim 10, further comprising a non-syllabic printing mechanism controlled directly by the output of the decoder.

14. A device as claimed in claim 10, further comprising a computer interface connected directly to the output of the decoder and by means of which the memorized codes may be transferred into a computer.

15. A device as claimed in claim 10, further comprising a system directly controlled by the output of the decoder to produce a permanent or quasipermanent record of the memorized codes.

16. A device as claimed in claim 15, in which the recording system includes perforators for making punched tapes which may be stored for ulterior printings.

17. A device as claimed in claim 15, in which the recording system is a magnetic system for producing recorded magnetic tapes which are continuous, so that they may be kept for ulterior printings.

* * * * *